US005334475A

United States Patent [19]

Kato

[11] Patent Number: 5,334,475

[45] Date of Patent: Aug. 2, 1994

[54] LIQUID DEVELOPER FOR ELECTROSTATIC PHOTOGRAPHY

[75] Inventor: Eiichi Kato, Shizuoka, Japan

[73] Assignee: Fuji Photo Film Co., Ltd., Kanagawa, Japan

[21] Appl. No.: 982,990

[22] Filed: Nov. 30, 1992

[30] Foreign Application Priority Data

Nov. 29, 1991 [JP] Japan ..... 3-339487
Dec. 4, 1991 [JP] Japan ..... 3-347633

[51] Int. Cl.[5] ..... G03G 9/12
[52] U.S. Cl. ..... 430/114; 430/115
[58] Field of Search ..... 430/114, 115, 49

[56] References Cited

U.S. PATENT DOCUMENTS

| | | | |
|---|---|---|---|
| 5,006,441 | 4/1991 | Kato | 430/114 |
| 5,035,971 | 7/1991 | Kato et al. | 430/114 |
| 5,043,241 | 8/1991 | Kato et al. | 430/114 |
| 5,112,716 | 5/1992 | Kato et al. | 430/114 |
| 5,114,822 | 5/1992 | Kato et al. | 430/114 |
| 5,141,835 | 8/1992 | Kato et al. | 430/115 |

*Primary Examiner*—John Goodrow
*Attorney, Agent, or Firm*—Sughrue, Mion, Zinn, Macpeak & Seas

[57] ABSTRACT

A liquid developer for electrostatic photography is disclosed. The liquid developer comprises at least resin grains dispersed in a non-aqueous solvent having an electric resistance of at least $10^9$ Ωcm and a dielectric constant of not higher than 3.5, wherein the dispersed resin grains are copolymer resin grains obtained buy polymerizing a solution containing (1) at least one monofunctional monomer (A) which is soluble in the above-described non-aqueous solvent but becomes insoluble therein by being polymerized, (2) at least one monomer (C) which contains a specific substituent and which is copolymerizable with said monofunctional monomer (A) represented by the general formula (I) below, (3) at least one polyfunctional monomer (D) having at least two polymerizable functional groups which are copolymerizable with said monofunctional monomer (A), and (4) at least one dispersion-stabilizing resin (P) soluble in said non-aqueous solvent, which is a polymer containing a repeating unit represented by the general formula (II) and the main chain of said polymer is partially crosslinked, or at least one dispersion-stabilizing resin (P') soluble in the non-aqueous solvent, which is an AB type block copolymer. The liquid developer of the present invention is excellent in dispersibility and redispersibility of resin grains, and resistivity, and provide a master plate for offset printing having high printing durability.

10 Claims, No Drawings

LIQUID DEVELOPER FOR ELECTROSTATIC PHOTOGRAPHY

FIELD OF THE INVENTION

This invention relates to a liquid developer for electrostatic photography, which comprises resin grains dispersed in a liquid carrier having an electric resistance of at least $10^9$ Ωcm and a dielectric constant of not higher than 3.5, and more particularly to an electrophotographic liquid developer excellent in dispersibility and redispersibility of resin grains, and resistivity to a treating solution.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several nm to several hundred nm, and it is important for the latex grains that the grains have uniform grain diameter and do not aggregate, precipitate or accumulate during storage thereof. If much requirements are not satisfied, there may be problems in causing poor reproduction of the images formed, stains of non-image portions or malfunctions of the developing machine, such as clogging of a liquid feed pump, etc.

For overcoming the above problems, a dispersion polymerization method in a non-aqueous system for obtaining insoluble latex grains having fine grain diameter and good monodispersibility has been proposed and has further been studied. For example, an improved method using a soluble dispersion-stabilizing resin is disclosed in U.S. Pat. Nos. 3,990,980 and 4,618,557, and JP-A-1-257969, JP-A-2-74956, JP-A-1-282566 and JP-A-2-173667 (the term "JP-A" as used herein means an "unexamined published Japanese patent application"), and a method for modifying the surface of latex grains by using a compound having a physical and chemical interaction with the monomer to be insolubilized is disclosed in U.S. Pat. No. 4,842,975, JP-A-62-151868, JP-A-1-237668, JP-A-2-168276, JP-A-2-116858 and JP-A-2-186351. These methods are described as being useful for improving degree of grain dispersion, grain diameter, redispersibility and storage stability.

On the other hand, studies for putting practical use or development of direct lithographic printing system using electrophotographic technique has recently been made actively. The system comprises forming a toner image on the surface of an electrophotographic light-sensitive material by electrophotographic system, and treating the resulting light-sensitive material to render the non-image portion thereof hydrophilic thereby producing a lithographic printing master plate.

Typical methods for rendering the non-image portion hydrophilic include a method for dissolving out the non-image area with a treating solution and utilizing hydrophilicity of the surface of the support under the electrophotographic light-sensitive layer, and a method for modifying an oleophilic property of the surface in the non-image portion of the light-sensitive layer to a hydrophilic property.

Recently, as an improved latter method for conventional oil-desensitization treatment of photoconductive zinc oxide in the light-sensitive layer, JP-A-62-21669, JP-A-1-191157 and JP-A-2-15277 disclose that hydrophilicity of the non-image portion can be increased by converting the binder resin used in the light-sensitive layer to a hydrophilic resin. In this system, it is important that the toner image portion remains unchanged upon treatment with the treating solution. Such a property is hereinafter referred to "resistivity" to the treating solution.

When a conventional liquid developer containing insoluble resin grains having good redispersibility is used in the above-described electrophotographic plate-making system and the non-image portion is sufficiently rendered hydrophilic, the toner does not show sufficient resistivity thereby sometimes causing loss of image portions. Such problems occur, in particular, in toner portions having small areas such as fine lines and letters or dot areas, and the quality of prints obtained from such a printing plate is deteriorated.

On the other hand, insoluble latex grains having high resistance to the treating solution, for example, styrene type latexes, possess sufficient resistivity, but these resins have low charge stability and redispersibility as toner grains and also provide complicated problems in apparatus since these resins require a high temperature and long time fixing procedure due to poor fixing property of the toner grains.

SUMMARY OF THE INVENTION

The present invention has been made for solving the above-described problems inherent to conventional electrophotographic liquid developers.

An object of the present invention is to provide a liquid developer excellent in dispersion stability, redispersibility, fixing property and resistivity to the treating solution for hydrophilization in an electrophotomechanical system.

Another object of the present invention is to provide a liquid developer capable of forming an offset printing master plate having excellent reproducibility of the duplicated image to the original by electrophotography.

Still another object of the present invention is to provide a liquid developer capable of forming an offset printing master plate having excellent receptivity for printing ink and printing durability by electrophotography.

A further object of the present invention is to provide a liquid developer capable of being used for any liquid developer-using systems such as ink jet recording, cathode ray tube recording, and recording by pressure variation or electrostatic variation.

The above-described objects have been attained by the present invention as described hereinafter in detail.

That is, the present invention provides a liquid developer for electrostatic photography comprising at least resin grains dispersed in a non-aqueous solvent having an electric resistance of atleast $10^9$ Ωcm and a dielectric constant of not higher than 3.5, wherein the dispersed resin grains are copolymer resin grains obtained by polymerizing a solution containing (1) at least one monofunctional monomer (A) which is soluble in the non-aqueous solvent but becomes insoluble therein by being polymerized, (2) at least one monomer (C) represented by the general formula (I) below which contains a specific substituent and which is copolymerizable with the monofunctional monomer (A), (3) at least one polyfunctional monomer (D) having at least two polymerizable functional groups which are copolymerizable with the monofunctional monomer (A), and (4) at least one dispersion-stabilizing resin (P) soluble in the non-aqueous solvent, which is a polymer containing a repeating unit represented by the general formula (II) and the main chain of the polymer is partially crosslinked, or at least one dispersion-stabilizing resin (P') soluble in the non-aqueous solvent, which is an AB block copolymer having a weight average molecular weight from $1\times10^4$ to $5\times10^5$ composed of an A block containing at least a polymerizable component represented by the general formula (II') described below and a B block comprising a polymerizable component containing at least one polar group selected from a carboxy group, a sulfo group, a hydroxyl group, a formyl group, an amino group, a phosphono group, a

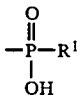

group (wherein $R^1$ represents $—R^2$ or $—OR^2$ (wherein $R^2$ represents a hydrocarbon group)), a

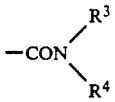

group, a

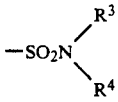

group (wherein $R^3$ and $R^4$ each represents a hydrogen atom or a hydrocarbon group) and a cyclic acid anhydride-containing group, and/or a polymerizable component corresponding to the monofunctional monomer (A);

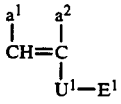

(I)

wherein $E^1$ represents an aliphatic group having 8 or more carbon atoms or a substituent selected from the substituents represented by the general formula (III)

$$-(A^1-B^1)_m-(A^2-B^2)_n-R^{21} \quad \text{(III)}$$

wherein $R^{21}$ represents a hydrogen atom or an aliphatic group having from 1 to 18 carbon atoms, $B^1$ and $B^2$ which may be the same different, each represents —O—, —S—, —CO—, $—CO_2—$ —OCO—, $—SO_2—$,

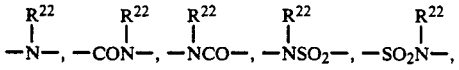

$—NHCO_2—$ or —NHCONH— (wherein $R^{22}$ has the same meaning as $R^{21}$), $A^1$ and $A^2$, which may be the same or different, each has a hydrocarbon group having from 1 to 18 carbon atoms which may be substituted and which may contain an intervening group represented by the following formula in the main chain of the hydrocarbon group;

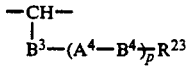

(wherein $B^3$ and $B^4$, which may be the same or different, each has the same meaning as $B^1$ and $B^2$, $A^4$ represents a hydrocarbon group having from 1 to 18 carbon atoms which may be substituted, and $R^{23}$ has the same meaning as R21), m, n and p, which may be the same or different, each represents an integer of from 0 to 4, provided that m, n and p cannot be 0 at the same time; $U^1$ represents —COO—, —CONH—,

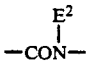

(wherein $E^2$ represents an aliphatic group or a substituent represented by the above general formula (III)), —OCO—, —CONHCOO—, $—CH_2COO—$, $—(CH_2)_sOCO—$ (wherein s represents an integer of from 1 to 4), —O— or $—C_6H_4—COO—$; $a^1$ and $a^2$, which may be the same or different, each represents a hydrogen atom, an alkyl group, $—COO—E^3$, or $—CH_2COO—E^3$ (wherein $E^3$ represents an aliphatic group);

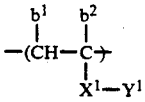

(II)

wherein $X^1$ represents —COO—, —OCO—, $—CH_2OCO—$, $—CH_2COO—$, —O— or $—SO_2—$; $Y_1$ represents an aliphatic group containing from 6 to 32 carbon atoms; $b^1$ and $b^2$, which may be the same or different, each represents a hydrogen atom, a halogen atom, a cyano group, a hydrocarbon group having from 1 to 8 carbon atoms, $—COO—Z^1$ or $—COO—Z^1$ bonded via a hydrocarbon group having from 1 to 8 carbon atoms (wherein $Z^1$ represents a hydrocarbon group having from 1 to 22 carbon atoms);

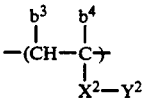

(II')

wherein $X^2$ represents —COO—, —OCO—, $—(CH_2)_y—COO—$, $—(CH_2)_y—OCO—$ (wherein y represents an integer of from 1 to 3) or —O—; $Y^2$ represents an aliphatic group having 10 or more carbon atoms; $b^3$ and $b^4$, which may be the same or different, each represents a hydrogen atom, a halogen atom, a cyano group, a hydrocarbon group, a $—COO—Z^2$ group or a —COO—$Z^2$ group bonded via a hydrocarbon group (wherein $Z^2$ represents a hydrogen atom or a hydrocarbon group which may be substituted).

Preferably, the polymer as dispersion-stabilizing resin (P) contains at least one polar group selected from —$PO_3H_2$, —$SO_3H$, —COOH,

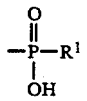

(wherein $R^1$ represents a hydrocarbon froup or —$OR^2$ (wherein $R^2$ represents a hydrocarbon group), —OH, a formyl group,

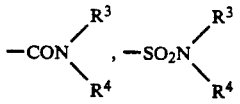

(wherein $R^3$ and $R^4$ each represents a hydrogen atom or a hydrocarbon group), a cyclic acid anhydride-containing group, and an amino group, at one terminal of the main chain of the polymer.

More preferably, the polymer as dispersion-stabilizing resin (P) contains a polymerizable functional group which is copolymerizable with the monomer (A), at one terminal of the main chain of the polymer.

Also, preferably, the AB block copolymer as dispersion-stabilizing resin (P') contains at least one polar group selected from the specific groups contains in the B block, at the terminal of the polymer main chain of the B block opposite to the terminal adjacent to the A block.

More preferably, the AB block copolymer as dispersion-stabilizing resin (P') contains a polymerizable functional group which is copolymerizable with the monomer (A), at the terminal of the polymer main chain of the B block opposite to the terminal adjacent to the A block.

DETAILED DESCRIPTION OF THE INVENTION

Then, the liquid developer of the present invention is described in detail.

As the liquid carrier for the liquid developer of the present invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be used. Examples of liquid carrier include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 solvent (Amsco: trade name of Americal Mineral Spirits Co.). They may be used singly or as a combination thereof.

The non-aqueous dispersed resin grains (hereinafter often referred to as "dispersed resin grains" or "latex grains") which are the most important constituting element in this invention are resin grains produced by polymerizing (so-called polymerization granulation method), in a non-aqueous solvent, at least one monofunctional monomer (A), at least one monomer (C) which contains a specific substituent, and at least one polyfunctional monomer (D), in the presence of a dispersion-stabilizing resin (P) soluble in the non-aqueous solvent which is a polymer having a partially crosslinked polymer chain, or a dispersion-stabilizing resin (P') soluble in the non-aqueous solvent which is an AB block copolymer.

As the non-aqueous solvent for use in the present invention, any solvents miscible with the above-described liquid carrier for the liquid developer for electrostatic photography can be basically used in the present invention.

That is, the non-aqueous solvent used in the production of the dispersed resin grains may be any solvent miscible with the above-described liquid carrier, and preferably includes straight chain or branched aliphatic hydrocarbons, alicyclic hydrocarbons, aromatic hydrocarbons, and halogen-substituted derivatives thereof.

Specific examples thereof are hexane, octane, isooctane, decane, isodecane, decalin, nonane, dodecane, isododecane, Isopar E, Isopar G, Isopar H, Isopar L, Shellsol 70, Shellsol 71, Amsco OMS, and Amsco 460. These solvents may be used singly or as a combination thereof.

Other solvents can be used together with the above-described organic solvents for the production of the non-aqueous dispersed resin grains, and examples thereof include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methylchloroform).

It is preferred that the non-aqueous solvents which are used as a mixture thereof are distilled off by heating or under a reduced pressure after completion of the polymerization granulation. However, even when the solvent is brought in the liquid developer as a latex grain dispersion, the solvent gives no problem if the liquid electric resistance of the liquid developer is in the range of satisfying the condition of at least $10^9$ Ωcm.

In general, it is preferred that the same solvent as the liquid carrier is used in the step of forming the resin dispersion and, such solvents include straight chain or branched aliphatic hydrocarbons, alicyclic hydrocarbons, aromatic hydrocarbons, halogenated hydrocarbons, etc., as described above.

The monofunctional monomer (A) used in the present invention may be a monofunctional monomer which is soluble in the non-aqueous solvent but becomes insoluble by being polymerized.

Practical examples of the monomer include the monomers represented by the following formula (IV);

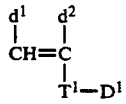

(IV)

wherein $T^1$ represents —COO—, —OCO—, —$CH_2$OCO—, —$CH_2$COO—, —O—, —CONHCOO—, —CONHOCO—, —$SO_2$—,

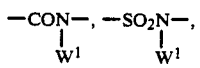

or

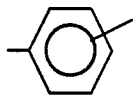

wherein $W^1$ represents a hydrogen atom or an aliphatic group having from 1 to 8 carbon atoms which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl).

$D^1$ in the above formula represents an aliphatic group having from 1 to 6 carbon atoms which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridiylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl).

Also, in the above formula (IV), $d^1$ and $d^2$, which may be the same or different, each represents the same group as $b^1$ or $b^2$ in formula (II).

Specific examples of the monofunctional monomer (A) are vinyl esters or allyl esters of an aliphatic carboxylic acid having from 1 to 6 carbon atoms (e.g., acetic acid, propionic acid, butyric acid, monochloroacetic acid, and trifluoropropionic acid); alkyl esters or alkyl amides (said alkyl having from 1 to 4 carbon atoms, which may be substituted) of an unsaturated carboxylic acid such as acrylic acid, methacrylic acid, crotonic acid, itaconic acid, maleic acid, etc. (examples of the alkyl group are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-furfurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, N,N-dimethylaminomethylstyrene, vinylbenzenecarboxyamide, and vinylbenzenesulfoamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond (practically the compounds described in *Kobunshi (Macromolecular) Data Handbook (Foundation)*, pages 175–184, edited by Kobunshi Gakkai, published by Baifukan, 1986, such as, for example, N-vinylpyridine, N-vinylimidazole, N-vinylpyrrolidone, vinylthiophene, vinyltetrahydrofuran, vinyloxazoline, vinylthiazole, and N-vinylmorpholine).

The monomers (A) may be used singly or as a combination thereof.

The monomer (C) which contains a specific substituent and which is represented by the general formula (I) used in the present invention is described hereinafter.

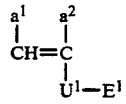

(I)

wherein $E^1$ represents an aliphatic group having 8 or more carbon atoms or a substituent selected from the substituents represented by the general formula (III)

$$-(A^1-B^1)_m-(A^2-B^2)_n-R^{21} \quad \text{(III)}$$

wherein $R^{21}$ represents a hydrogen atom or an aliphatic group having from 1 to 18 carbon atoms, $B^1$ and $B^2$ which may be the same different, each represents —O—, —S—, —CO—, —$CO_2$— —OCO—, —$SO_2$—,

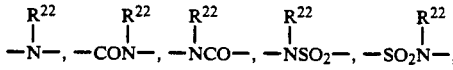

—$NHCO_2$— or —NHCONH— (wherein $R^{22}$ has the same meaning as $R^{21}$), $A^1$ and $A^2$, which may be the same or different, each has a hydrocarbon group having from 1 to 18 carbon atoms which may be substituted and which may contain an intervening group represented by the following formula in the main chain of the hydrocarbon group;

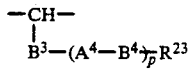

(wherein $B^3$ and $B^4$, which may be the same or different, each has the same meaning as $B^1$ and $B^2$, $A^4$ represents a hydrocarbon group having from 1 to 18 carbon atoms which may be substituted, and $R^{23}$ has the same meaning as $R^{21}$), m, n and p, which may be the same or different, each represents an integer of from 0 to 4, provided that m, n and p cannot be 0 at the same time; $U^1$ represents —COO—, —CONH—,

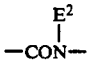

(wherein $E^2$ represents an aliphatic group or a substituent represented by the above general formula (III)), —OCO—, —CONHCOO—, —$CH_2$COO—, —$(CH_2)_s$OCO— (wherein s represents an integer of from 1 to 4), —O— or —$C_6H_4$—COO—; $a^1$ and $a^2$, which may be the same or different, each represents a hydrogen atom, an alkyl group, —COO—$E^3$ or —$CH_2$COO—$E^3$ (wherein $E^3$ represents an aliphatic group).

The monomer (C) represented by the general formula (I) wherein $E^1$ represents an aliphatic group having 8 or more carbon atoms is described below in more detail.

In formula (I), $E^1$ represents preferably an alkyl group having a total number of carbon atoms of 10 or more, which may be substituted, or an alkenyl group having a total number of carbon atoms of 10 or more, which may be substituted.

$U^1$ represents preferably —COO—, —CONH—, $$-\overset{\overset{E^2}{|}}{C}ON-$$

(wherein $E^2$ represents preferably an aliphatic group having from 1 to 32 carbon atoms (examples of the aliphatic group are an alkyl group, an alkenyl group, or an aralkyl group), —OCO—, —$CH_2OCO$— or —O—.

Also, $a^1$ and $a^2$, which may be the same or different, each represents preferably a hydrogen atom, a methyl group, —$COOE^3$, or —$CH_2COOE^3$ (wherein $E^3$ represents preferably an alkyl group having from 1 to 32 carbon atoms, an alkenyl group, an aralkyl group, or a cycloalkyl group).

In formula (I), it is more preferable that $U^1$ represents —COO—, —CONH—, or $$-\overset{\overset{E^2}{|}}{C}ON-;$$

$ca^1$ and $a^2$, which may be the same or different, each represents a hydrogen atom or a methyl group; and $E^1$ has the same meaning as described above.

Specific examples of the monomer (C) shown by formula (I) (wherein $E^1$ represents an aliphatic group having 8 or more carbon atoms) are unsaturated carboxylic acid esters having an aliphatic group of from 10 to 32 total carbon atoms (examples of the carboxylic acid are acrylic acid, methacrylic acid, crotonic acid, maleic acid, and itaconic acid, and examples of the aliphatic group are decyl, dodecyl, tridecyl, tetradecyl, hexadecyl, octadecyl, docosanyl, dodecenyl, hexadecenyl, oleyl, linoleyl, and docosenyl; the above aliphatic group may have a substituent such as a halogen atom, a hydroxy group, an amino group, an alkoxy group, etc., or may have a hetero atom such as oxygen, sulfur, nitrogen, etc. in the carbon-carbon bond of the main chain thereof); unsaturated carboxylic acid amides having an aliphatic group having from 10 to 32 carbon atoms (the unsaturated carboxylic acid and the aliphatic group are same as those described above on the esters); vinyl esters or allyl esters of a higher aliphatic acid (examples of the higher aliphatic acid are lauric acid, myristic acid, stearic acid, oleic acid, linolic acid, and behenic acid); and vinyl ethers substituted with an aliphatic group having from 10 to 32 carbon atoms (wherein the aliphatic group is the same as described above for the unsaturated carboxylic acid esters).

The monomer (C) represented by the general formula (I) wherein $E^1$ represents a substituent represented by the general formula (III) above is described below in more detail.

Specific examples of $A^1$ and $A^2$ include $$-\overset{\overset{R^{24}}{|}}{\underset{\underset{R^{25}}{|}}{C}}-$$

(wherein $R^{24}$ and $R^{25}$ each represents a hydrogen atom, an alkyl group or a halogen atom), —(CH=CH)—, a cyclohexylene group (which is hereinafter represented by —$C_6H_{10}$, including a 1,2-cyclohexylene group, a 1,3-cyclohexylene group and a 1,4-cyclohexylene group), or the atomic group $$-\underset{\underset{B^3-(A^4-B^4)_n-R^{23}}{|}}{CH}-,$$

or any combination thereof.

Also, in linking the group $$-U^1-(A^1-B^1)_m-(A^2-B^2)_n-R^{21},$$

it is preferred that the linkage main chain composed of $U^1$, $A^1$, $B^1$, $A^2$, $B^2$, and $R^{21}$ has a total number of atoms of at least 8. In this case, when $U^1$ represents $$-\overset{\overset{E^2}{|}}{C}ON-$$

and $E^2$ represents $$-(A^1-B^1)_m-(A^2-B^2)_n-R^{21},$$

the linkage main chain composed by $E^2$ is included in the above-described linkage main chain. Furthermore, $$-B^3-(A^4-B^4)_p-R^{23},$$

in the case where $A^1$ or $A^2$ represents a hydrocarbon group containing $$-\underset{\underset{B^3-(A^4-B^4)_p-R^{23}}{|}}{CH}-$$

in the main chain bond is also included in the above-described linkage main chain.

As to the number of atoms of the linkage main chain, when, for example, $U^1$ represents —COO— or —CONH—, the oxo group (=0) and the hydrogen atom are not included in the number of atoms but the carbon atom(s), ether-type oxygen atom, and nitrogen atom each constituting the linkage main chain are included in the number of atoms. Thus, the numben of atoms of —COO— or —CONH— is counted as 2. Also, when, for example, $R^{21}$ represents —$C_9H_{19}$, the hydrogen atoms thereof are not included in the number of atoms and the carbon atoms are included therein. Thus, the number of atoms in this case is counted as 9.

Specific examples of the monomer (C) represented by the general formula (I) wherein $E^1$ represents a substituent represented by the general formula (III), that is, the monomer containing a specific polar group, include the following compounds.

(I-1)
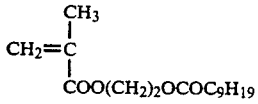
(I-2)
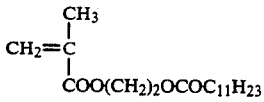
(I-3)
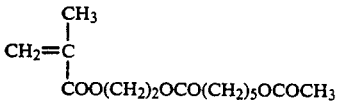
(I-4)
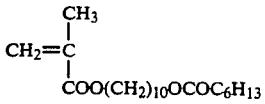
(I-5)
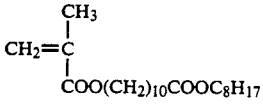
(I-6)
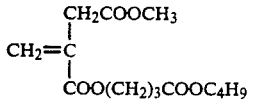
(I-7)
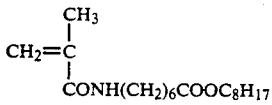
(I-8)
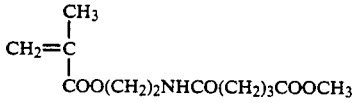
(I-9)
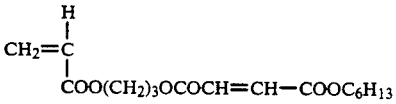
(I-10)
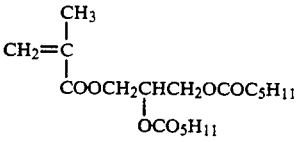
(I-11)
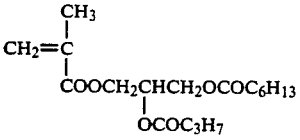
(I-12)
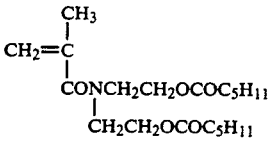
(I-13)
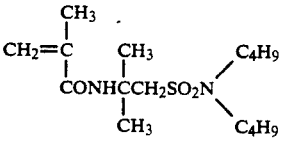
-continued
(I-14)
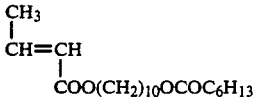
(I-15)
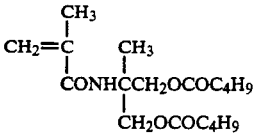
(I-16)
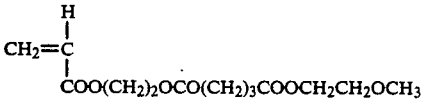
(I-17)
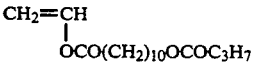
(I-18)
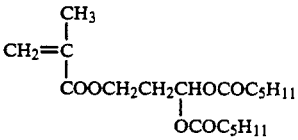
(I-19)
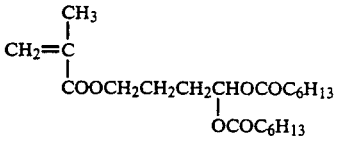
(I-20)
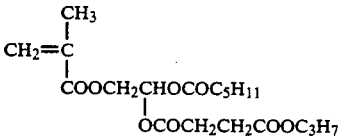
(I-21)
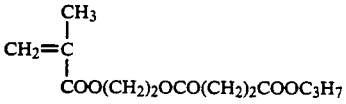
(I-22)
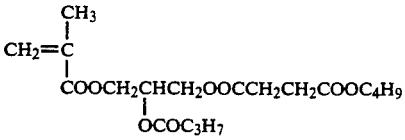
(I-23)
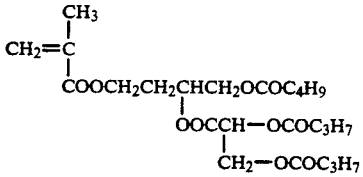
(I-24)
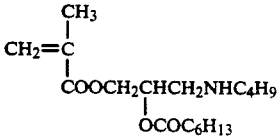
(I-25)
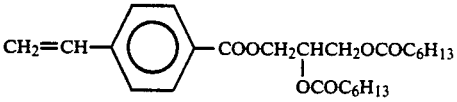

-continued $$CH_2{=}CH{-}CH_2{-}OCO(CH_2)_2COOCH_2\underset{\underset{OCOC_4H_9}{|}}{CH}CH_2OCOC_4H_9 \quad \text{(I-26)}$$

$$CH_2{=}\overset{\overset{CH_3}{|}}{C}{-}COOCH_2\underset{\underset{OCOC_5H_{11}}{|}}{CH}CH_2NHCH_2CH_2OCOCH_3 \quad \text{(I-27)}$$

$$CH_2{=}\overset{\overset{CH_3}{|}}{C}{-}COOCH_2CH_2NHCOOC_4H_9 \quad \text{(I-28)}$$

$$\overset{\overset{CH_3}{|}}{CH}{=}CH{-}COOCH_2\underset{\underset{OCOC_3H_7}{|}}{CH}CH_2OOC{-}\underset{\underset{CH_2OCOC_5H_{11}}{|}}{CH}OCOC_5H_{11} \quad \text{(I-29)}$$

The monomer (D) having two or more polymerizable functional groups which is copolymerizable with the monomer (A) (hereinafter referred to as polyfunctional monomer (D)) used in the present invention in combination with the monofunctional monomer (A) and the monomer (C) is described in more detail.

The polymerizable functional group contained in the polyfunctional monomer (D) may be any group which is copolymerizable with the monomer (A), and a specific example of the functional group is represented by the following general formula (V)

$$\overset{\overset{d^1}{|}}{CH}{=}\overset{\overset{d^2}{|}}{C}{-}T^1 \quad \text{(V)}$$

wherein $d^1$, $d^2$ and $T^1$ have the same meaning as $d^1$, $d^2$ and $T^1$, respectively, defined for the above formula (IV).

Also, the polyfunctional monomer (D) may be a monomer having 2 or more same or different polymerizable functional groups, and forms a polymer insoluble in the non-aqueous solvent by polymerizing with the monomer (A) and the monomer (C).

Examples of the monomer having same polymerizable functional groups are styrene derivatives such as divinylbenzene, trivinylbenzene, etc.; methacrylic acid, acrylic acid or crotonic acid esters of a polyhydric alcohol (e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol) or a polyhydroxyphenol, (e.g., hydroquinone, resorcinol, catechol, and the derivative thereof), vinyl ethers, and allyl ethers; vinyl esters, allyl esters, vinylamides and allyl amides of a dibasic acid (e.g., malonic acid, succinic acid, glutaric acid, adipic acid, pimelic acid, maleic acid, phthalic acid, and itaconic acid); and condensates of polyamides (e.g., ethylenediamine, 1,3-propylenediamine, and 1,4-butylenediamine) and a carboxylic acid having a vinyl group (e.g., methacrylic acid, acrylic acid, crotonic acid, and allylacetic acid).

Also, examples of the monomer having different polymerizable functional groups are vinyl group-having ester derivatives or amide derivatives (e.g., vinyl methacrylate, vinyl acrylate, vinyl itaconate, allyl itaconate, allyl acrylate, allyl itaconate, vinyl methacryloylacetate, vinyl methacryloylpropionate, allyl methacryloylpropionate, methacrylic acid vinyloxycarbonyl methyl ester, acrylic acid vinyloxycarbonylmethyloxy-carbonylethylene ester , N-allylacrylamide, N-allylmethacrylamide, N-allylitaconic acid amide, and methacryloylpropionic acid allyl amide) of vinyl group-having carboxylic acids (e.g., methacrylic acid, acrylic acid, methacryloylacetic acid, acryloylacetic acid, methacryloylpropionic acid, acryloylpropionic acid, itaconiloylacetic acid, itaconyloylpropionic acid, and reaction products of carboxylic acids and alcohols or amines (e.g., allyloxycarbonylpropionic acid, allyloxycarbonylacetic acid, 2-allyloxycarbonylbenzoic acid, and allylaminocarbonylpropionic acid)); and condensates of aminoalcohols (e.g., aminoethanol, 1-aminopropanol, 1-aminobutanol, 1-aminohexanol, and 2-aminobutanol) and vinyl group-having carboxylic acids.

The dispersed resin according to the present invention comprises at least one of each of the monomer (A), the monomer (C) and monomer (D). It is important that when a resin synthesized from such monomers is insoluble in the non-aqueous solvent, the desired dispersed resin grain can be obtained.

More specifically, it is preferred to use from 0.1 to 20% by weight, more preferably from 0.3 to 8% by weight, of the monomer (C) represented by the general formula (I) to the monomer (A) to be insolubilized.

The monomer (D) having two or more polymerizable functional groups used in the present invention is used in an amount of not more than 20 mol %, preferably not more than 10 mol %, of the total monomers.

The dispersed resin of the present invention preferably has a molecular weight of from $1\times10^3$ to $1\times10^6$, more preferably from $1\times10^4$ to $1\times10^6$.

The dispersion-stabilizing resin (P) of the present invention used for forming a stable resin dispersion from the polymer which is insoluble in the non-aqueous solvent and which is produced by polymerization of the monomers in the non-aqueous solvent is a polymer containing at least one repeating unit represented by the general formula (II). The polymer is partially cross-linked in the polymer main chain and is a resin insoluble in the non-aqueous solvent.

$$-(\overset{\overset{b^1}{|}}{CH}{-}\underset{\underset{X^1-Y^1}{|}}{\overset{\overset{b^2}{|}}{C}})- \quad \text{(II)}$$

wherein $X^1$ represents —COO—, —OCO—, —$CH_2$OCO—, —$CH_2$COO—, —O— or —$SO_2$—, $Y^1$ represents an aliphatic group having from 6 to 32 carbon atoms, $b^1$ and $b^2$, which may be the same or different, each represents a hydrogen atom, a halogen atom, a cyano group, a hydrocarbon group having from 1 to 8 carbon atoms, —COO—$Z^1$ or —COO$Z^1$ bonded via a hydrocarbon group (wherein $Z^1$ represents a hydrocarbon group having from 1 to 22 carbon atoms).

In the repeating unit represented by formula (II), the aliphatic group and the hydrocarbon group may be substituted.

In formula (II), $X^1$ is preferably —COO—, —OCO—, —$CH_2OCO$—, —$CH_2COO$— or —O—, more preferably —COO—, —$CH_2COO$— or —O—.

$Y^1$ preferably represents an alkyl group, an alkenyl group or an aralkyl group having from 8 to 22 carbon atoms which may be substituted. Examples of the substitent include a halogen atom (e.g., fluorine, chlorine and bromine atoms), —O—$Z^2$, —COO—$Z^2$ and —O-CO—$Z^2$ wherein $Z^2$ represents an alkyl group having from 6 to 22 carbon atoms, e.g., hexyl octyl, decyl, dodecyl, hexadecyl and octadecyl groups. More preferably, $Y^1$ represents an alkyl group or an alkenyl group having from 8 to 22 carbon atoms, for example, octyl, decyl, dodecyl, tridecyl tetradecyl, hexadecyl, octadecyl, docosanyl, decenyl, dodecenyl, tetradecenyl, hexadecenyl, and octadecenyl groups.

$b^1$ and $b^2$ which may be the same or different, each preferably represents a hydrogen atom, a halogen atom (e.g., fluorine, chlorine or bromine), a cyano group, an alkyl group having 1 to 3 carbon atoms, —COO—$Z^3$ or —$CH_2COO$—$Z^3$ (wherein $Z^3$ represents an aliphatic group having from 1 to 22 carbon atoms, e.g., methyl, ethyl, propyl, butyl, hexyl, octyl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl and octadecenyl, and these aliphatic groups may be substituted with the substituent as defined for Y1 above). More preferably, $b^1$ and $b^2$ each represents a hydrogen atom, an alkyl group having from 1 to 3 carbon atoms (e.g., methyl, ethyl and propyl groups), —COO—$Z^4$ or —$CH_2COO$—$Z^4$ (wherein $Z^4$ represents an alkyl group or an alkenyl group having from 1 to 12 carbon atoms, e.g., methyl, ethyl, propyl, butyl, hexyl, octyl, decyl, dodecyl, pentenyl, hexenyl, heptyl, octenyl and decenyl groups, and these alkyl and alkenyl groups may have a substituent as defined for $Y^1$ above).

The dispersion-stabilizing resin (P) of the presentinvention contains a copolymer component obtained by copolymerizing a monomer corresponding to the repeating unit represented by the general formula (II) above and other monomers which are copolymerizable with the above monomer, and is a polymer partially cross-linked in the polymer main chain thereof.

Other copolymerizable monomers may be any monomers containing a polymerizable double bond group, and examples of other monomers include unsaturated carboxylic acids such as acrylic acid, methacrylic acid, crotonic acid, and itaconic acid; ester derivatives or amide derivatives of unsaturated carboxylic acids having not more than 6 carbon atoms; vinyl esters or allyl esters of carboxylic acids; styrenes; methacrylonitrile; acrylonitrile; and heterocyclic compounds containing a polymerizable double bond group. More specifically, the monomer includes the same compounds as the above-described monomer (A) to be insolubilized.

The proportion of the repeating unit component represented by the general formula (II) in the polymer components of the dispersion-stabilizing resin (P) is at least 30 wt %, preferably 50 wt % or more, and more preferably 70 wt % or more, based on the total polymer components.

As a method for introducing a crosslinking structure into the polymer, a conventional method can be used. More specifically, (1) a method for polymerization reaction of monomers in the presence of a polyfunctional monomer, and (2) a method for crosslinking by polymer reaction by incorporating a functional group which promotes a crosslinking reaction into the polymer.

In the dispersion-stabilizing resin (P) of the present invention, a crosslinking reaction by a functional group having a self-crosslinking ability, i.e., —$CONHCH_2OZ^5$ wherein $Z^5$ represents a hydrogen atom or an alkyl group) or a crosslinking reaction by polymerization is appropriately used since these methods do not suffer from problems such as a reaction for a long period of time, a non-quantitative reaction and contamination with impurities such as reaction accelerating agents.

The term "crosslinking reaction by polymerization" means a crosslinking between polymer chains by polymerization of the monomer having, preferably, at least two polymerizable functional groups and the monomer corresponding to the repeating unit represented by formula (II) above.

Specific examples of polymerizable functional groups include $CH_2{=}CH$—, $CH_2{=}CH{-}CH_2$—, $CH_2{=}CH{-}CO{-}O$—,

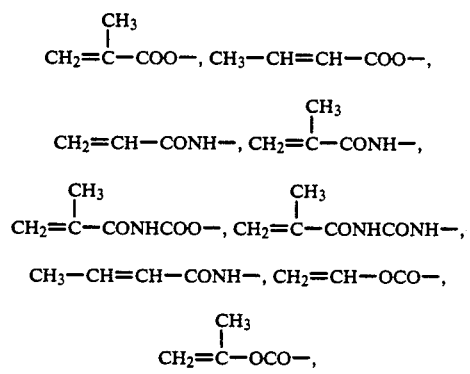

$CH_2{=}CH{-}CH_2{-}OCO$—, $CH_2{=}CH{-}NHCO$—, $CH_2{=}CH{-}CH_2{-}NHCO$—, $CH_2{=}CH{-}SO_2$—, $CH_2{=}CH{-}CO$—, $CH_2{=}CH{-}O$—, $CH_2{=}CH{-}S$—.

The monomers having two or more polymerizable functional groups may be those having the same or different polymerizable functional groups described above.

Specific examples of the monomer having two or more polymerizable functional groups include the same compounds as the polyfunctional monomers (D).

The monomer having two or more polymerizable functional groups used in the present invention is used for the polymerization in an amount of not more than 10 wt %, preferably not more than 8 wt %, to form a resin which is soluble in the non-aqueous solvent according to the present invention.

The dispersion-stabilizing resin (P) according to the present invention preferably has a specific polar group bonded to at least one terminal of the polymer chain thereof. (The resin of this type is hereinafter referred to as dispersion-stabilizing resin (PA) or resin (PA).)

The specific polar group is selected from —$PO_3H_2$, —$SO_3H$, —COOH,

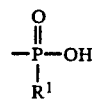

(wherein $R^1$ represents a hydrocarbon group or $—OR^2$ (wherein $R^2$ represents a hydrocarbon group)), —OH, a formyl group,

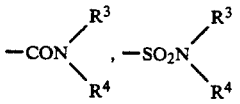

(wherein $R^3$ and $R^4$ each represents a hydrogen atom or a hydrocarbon group), a cyclic acid anhydride-containing group and an amino group.

In the polar group represented by

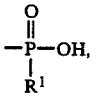

the hydrocarbon group of $R^1$ or $R^2$ is preferably a hydrocarbon group having from 1 to 10 carbon atoms, more preferably an aliphatic group having from 1 to 8 carbon atoms which may be substituted (e.g., methyl, ethyl, propyl, butyl, pentyl, hexyl, butenyl, pentenyl, hexenyl, 2-chloroethyl, 2-cyanoethyl, cyclopentyl, cyclohexyl, benzyl, phenethyl, chlorobenzyl, and bromobenzyl), or an aromatic group which may be substituted (e.g., phenyl, tolyl, xylyl, mesityl, chlorophenyl, bromophenyl, methoxyphenyl, and cyanophenyl).

In the polar group of

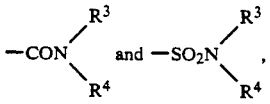

$R^3$ and $R^4$ each represents a hydrogen atom or a hydrocarbon group, preferably a hydrocarbon group having from 1 to 8 carbon atoms which may be substituted. Specific examples of the hydrocarbon group represented by $R^3$ and $R^4$ are the same as those described for $R^1$ and $R^2$ above.

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for examples, a halogen atom such as a chlorine atom and a bromine atom, and an alkyl group such as a methyl group, an ethyl group, a butyl group and a hexyl group.

Specific examples of the aromatic dicarboxylic acid anhydrides include phthalic anhydride ring, naphthalene-dicarboxylic acid anhydride ring, pyridinedicarboxylic acid anhydride ring and thiophenedicarboxylic acid anhydride ring. These rings may be substituted with, for example, a halogen atom (e.g., chlorine and bromide), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

Of the above polar groups, the amino group is represented by $—NH_2$, $—NHR^5$ or $—NR^5R^6$ wherein $R^5$ and $R^6$ each represents a hydrocarbon group having from 1 to 8 carbon atoms, preferably from 1 to 7 carbon atoms. Specific examples of the hydrocarbon groups are the same as those described for $R^1$.

In the dispersion-stabilizing resin (PA), at least one specific polar group described above may be bonded to one terminal of the polymer main chain directly or via an appropriate linking group. The linking group bonding a component of the polymer chain and a polar group-containing component is composed of any combination of the atomic groups of a carbon-carbon bond (a single bond or a double bond), a carbon-heteroatom bond (e.g., an oxygen atom, a sulfur atom, a nitrogen atom or a silicon atom as a heteroatom), a heteroatom-heteroatom bond.

Specific examples of suitable linking group include

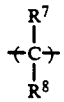

(wherein $R^7$ and $R^8$, which may be the same or different, each represents a hydrogen atom, a halogen atom (e.g., fluorine, chlorine, and bromide), a cyano group, a hydroxyl group, an alkyl group (e.g., methyl, ethyl, and propyl), $$—(CH{=}CH)—,$$

$—C_6H_{10}—$ which represents 1,2-, 1,3- or 1,4-cyclohexylene, a phenylene group, —O—, —S—, —CO—, $—NR^9—$, —COO—, $—SO_2—$, $—CONR^9—$, $—SO_2NR^9—$, —NHCOO—, —NHCONH—, $—SiR^9R^{10}—$ (wherein $R^9$ and $R^{10}$ each represents a halogen atom or a hydrocarbon group which is the same as $R^1$ in the above-described polar group), singly or as a combination composed of any two or more atomic groups selected from the above groups.

Further, a preferred embodiment of the dispersion-stabilizing resin (P) is a resin having a polymerizable functional group which is copolymerizable with the monomer (A) bonded to at least one terminal of the polymer main chain. (The resin of this type is hereinafter referred to as dispersion-stabilizing resin (PB) or resin (PB).)

Examples of the polymerizable functional group of the dispersion-stabilizing resin (PB) include the functional group represented by the general formula (V) described for the polymerizable functional group in the above-described polyfunctional monomer (D).

Also, the polymerizable functional group may be bonded to one terminal of the polymer main chain directly or via an appropriated linking group. The linking group can be the same as that described for the dispersion-stabilizing resin (PA).

The weight average molecular weight of the dispersion-stabilizing resin (P) of the present invention is preferably from $1\times10^4$ to $1\times10^6$, and more preferably from $2.5\times10^4$ to $2\times10^5$. If the weight average molecular weight is below $1\times10^4$, the average grain diameter of the resin grain obtained by the polymerization-granulation becomes large (e.g., more then 0 5 μm) and the distribution of the grain diameter becomes broad. Also, if it exceeds $1\times10^6$, the average grain diameter of the resin grain obtained by the polymerization-granulation becomes large thereby making it difficult to obtain grains having a uniform average grain diameter within a preferred range of from 0.15 to 0.4 μm.

The dispersion-stabilizing resin (P) used in the present invention is soluble in an organic solvent and, specifically, it may have a solubility of at least 5 parts by weight per 100 parts by weight of toluene at 25° C.

The dispersion-stabilizing resin (P) used in the present invention can be easily and preferably prepared by a conventional method comprising polymerizing the monomer corresponding to the repeating unit represented by the general formula (II) in the presence of at least the above-described polyfunctional monomer using a polymerization-initiator (e.g., an azobis type compound or a peroxide).

The polymerization initiator can be used in an amount of from 0.5 to 15 wt %, preferably from 1 to 10 wt %, per 100 parts by weight of the total monomers.

The dispersion-stabilizing resin (PA) which is a preferred embodiment of the present invention, in which the specific polar group is bonded to only one terminal of the polymer main chain, can easily be prepared by an ion polymerization process, in which a various kind of reagents is reacted at the terminal of a living polymer obtained by conventionally known anion polymerization or cation polymerization; a radical polymerization process, in which radical polymerization is performed in the presence of a polymerization initiator and/or a chain transfer agent which contains the specific polar group in the molecule thereof; or a process in which a polymer having a reactive group (for example, an amino group, a halogen atom, an epoxy group, and an acid halide group) at the terminal obtained by the above-described ion polymerization or radical polymerization is subjected to a polymer reaction to convert the terminal reactive group into the specific polar group.

More specifically, reference can be made to, e.g., P. Dreyfuss and R. P. Quirk, *Encycl. Polym. Sci. Eng.*, 7, 551 (1987), Yoshiki Nakajo and Yuya Yamashita, *Senryo to Yakuhin (Dyes and Chemicals)*, 30, 232 (1985), Akira Ueda and Susumu Nagai, *Kagaku to Kogyo (Science and Industry)*, 60, 57 (1986) and the literature references cited therein.

The weight average molecular weight of the dispersion-stabilizing resin (PA) of the present invention is preferably from $1\times10^4$ to $2\times10^5$, and more preferably from $2.5\times10^4$ to $1\times10^5$. If the weight average molecular weight is below $1\times10^4$ the average grain diameter of the resin grain obtained by the polymerization-granulation becomes large (e.g., more then 0.5 μm) and the distribution of the grain diameter becomes broad. Also, if it exceeds $2\times10^5$ the average grain diameter of the resin grain obtained by the polymerization-granulation becomes large thereby making it difficult to obtain grains having a uniform average grain diameter within a preferred range of from 0.15 to 0.4 μm.

More specifically, the dispersion-stabilizing resin (PA) used in the present invention can be prepared by (1) a method comprising polymerization of a mixture of the monomer corresponding to the repeating unit represented by the general formula (II), the above-described polyfunctional monomer and a chain transfer agent containing the above-described specific polar group, using a polymerization initiator (e.g., an azobis compound, a peroxide, etc.), (2) a method comprising the above polymerization but using a polymerization initiator containing the polar group in place of the chain transfer agent, (3) a method of using compounds containing the polar groups as the chain transfer agent and the polymerization initiator, or (4) a method comprising the polymerization according to the method (1), (2) or (3) above in which compounds containing an amino group, a halogen atom, an epoxy group, an acid halide as a substituent are used as chain transfer agent and polymerization initiator, followed by introducing the polar group by reacting with these functional groups.

Specific examples of chain transfer agents which can be used include mercapto compounds containing the polar group or the reactive group capable of being converted into the polar group (e.g., thioglycolic acid, thiomalic acid, thiosalicylic acid, 2-mercaptopropionic acid, 3-mercaptopropionic acid, 3-mercaptobutyric acid, N-(2-mercaptopropionyl)glycine, 2-mercaptonicotinic acid, 3-[N-(2-mercaptoethyl)carbamoyl]propionic acid, 3-[N-(2-mercaptoethyl)amino]propionic acid, N-(3-mercaptopropionyl)alanine, 2-mercaptoethanesulfonic acid, 3-mercaptopropanesulfonic acid, 4-mercaptobutanesulfonic acid, 2-mercaptoethanol, 3-mercapto-1,2-propanediol, 1-mercapto-2-propanol, 3-mercapto-2-butanol, mercaptophenol, 2-mercaptoethylamine, 2-mercaptoimidazole, 2-mercapto-3-pyridinol, and alkyl iodide compounds containing the polar group or the polar group-forming reactive group (e.g., iodoacetic acid, iodopropionic acid, 2-iodoethanol, 2-iodoethanesulfonic acid, and 3-iodopropanesulfonic acid), preferably a mercapto compound.

Specific examples of the polymerization initiators containing the polar group or the substituent which can be converted into the polar group include 4,4'-azobis(4-cyanovaleric acid), 4,4'-azobis(4-cyanovaleric acid chloride), 2,2'-azobis(2-cyanopropanol), 2,2'-azobis(2-cyanopentanol), 2,2'-azobis[2-(5-hydroxy-3,4,5,6-tetrahydropyrimidin-2-yl)propane, 2,2'-azobis{2-methyl-N-[1,1-bis(hydroxymethyl)-2-hydroxyethyl]propionamide}, 2,2'-azobis{2-methyl-N-[1,1-bis(hydroxymethyl)ethyl]propioamide}, 2,2'-azobis[2-methyl-N-(2-hydroxyethyl)propionamide], and 2,2'-azobis(2-amidinopropane).

The chain transfer agent or polymerization initiator is usually used in an amount of from 0.1 to 15 parts by weight, preferably from 0.5 to 10 parts by weight.

Further, the dispersion-stabilizing resin (PB) having a polymerizable double bond group bonded to at least one terminal of the polymer main chain which is a preferred embodiment of the present invention can be easily be prepared by reacting a reagent containing a double bond group with a living polymer obtained by the conventional anion polymerization or cation polymerization at the terminal of the living polymer, or by reacting a reagent containing a specific reactive group (e.g., —OH, —COOH, —$SO_3H$, —SH, —$NH_2$—, —$PO_3H_2$, —NCO, —NCS,

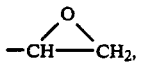

—COCl, and —$SO_2CL$) with the living polymer at the terminal and then introducing a polymerizable double bond group by polymer reaction (i.e., a method by ion polymerization), or by performing a radical polymerization using a polymerization initiator and/or a chain transfer agent containing the above specific reactive group in the molecule and then introducing a polymerizable double bond group thereto by performing a polymer reaction utilizing the specific reactive group bonded to only one terminal of the polymer main chain thereby in-troducing the polymerizable double bond group into the polymer.

Practically, the polymerizable double bond group can be introduced into the polymer according to the methods described in P. Dreyfuss & R. P. Quirk, *Encycl. Polymer Sci. Eng.*, 7, 551 (1987), Yoshiki Nakajo and Yuya Yamashita, *Senryo to Yakuhin (Dyes and Chemicals)*, 30, 232 (1985), Akira Ueda and Susumu Nagai, *Kagaku to Kogyo (Science and Industry)*, 60 (1986), P. F. Rempp & E. Franta, *Advances in Polymer Science*, 58, 1 (1984), Koichi Ito, *Kobunshi Kako (Polymer Processing)*, 35, 262 (1986), V. Percec, *Applied Polymer Science*, 285, 97 (1984) and the literature references cited therein.

More specifically, a method for introducing the polymerizable double bond group by polymer reaction utilizing the specific polar group of the dispersion-stabilizing resin (PA) is preferred.

The dispersion-stabilizing resin (P') used in the present invention is an AB block copolymer which is composed of a block comprising a polymer component of a repeating unit represented by the formula (II') (called as "A block") and a block comprising a polymer component containing at least one specific polar group as described above and/or a polymer component corresponding to the monofunctional monomer (A), and which has a weight average molecular weight of from $1\times10^4$ to $5\times10^5$.

The ratio of the A block and the B block in the AB block copolymer used in the present invention preferably ranges from 99/1 to 50/50 by weight.

The content of the polar group-containing component in the B block is preferably from 1 to 30 parts by weight, more preferably from 1 to 15 parts by weight, per 100 parts by weight of the dispersion-stabilizing resin. Also, when the polar group-containing polymer component is not present in the B block, the content of the polymer component corresponding to the above-described monofunctional monomer (A) is preferably from 5 to 50 parts by weight, more preferably 10 to 40 parts by weight, per 100 parts by weight of the dispersion-stabilizing resin.

The weight average molecular weight of the AB block copolymer is preferably from $2\times10^4$ to $1\times10^5$.

The repeating unit represented by the formula (II') which constitutes the A block is described hereinafter in detail.

In formula (II'), $X^2$ preferably represents —COO—, —OCO—, or —O—.

$Y^2$ in formula (II') represents an alkyl or alkenyl group having 10 or more carbon atoms which may be straight chain or branched chain. Specific examples thereof include decyl, dodecyl, tridecyl tetradecyl, hexadecyl, octadecyl, eicosanyl, docosanyl, decenyl, dodecenyl, tridecenyl, hexadecenyl, octadecenyl, linoleyl groups.

$b^3$ and $b^4$, which may be the same or different, each preferably represents a hydrogen atom, a halogen atom (e.g., chlorine or bromine), a cyano group, an alkyl group having 1 to 3 carbon atoms (e.g., methyl, ethyl and propyl), —COO—$Z^2$ or —$CH_2$COO—$Z^2$ (wherein $Z^2$ represents a hydrogen atom or a hydrocarbon group having not more than 22 carbon atoms which may be substituted (e.g., an alkyl group, an alkenyl group, an aralkyl group, an alicyclic group, and an aryl group).

Specific examples of $Z^2$ include a hydrogen atom, and, as a preferred hydrocarbon group, an alkyl group having 1 to 22 carbon atoms which may be substituted (e.g., methyl, ethyl, propyl, butyl, heptyl, hexyl, octyl, nonyl, decyl, dodecyl, tridecyl, tetradecyl, hexadecyl, octadecyl, eicosanyl, docosanyl, 2-chloroethyl, 2-bromoethyl , 2-cyanoethyl , 2-methoxycarbonylethyl, 2-methoxyethyl, and 3-bromopropyl), an alkenyl group having 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, 4-methyl-2-hexenyl, decenyl, dodecenyl, tridecenyl, hexadecenyl, octadecenyl, and linolenyl), an aralkyl group having 7 to 12 carbon atoms which may be substituted (e.g., benzyl, phenethyl , 3-phenylpropyl , naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

The A block of the dispersion-stabilizing resin (P') used in the present invention may contain other repeating units as copolymer components in addition to the repeating unit represented by formula (II'). Such copolymer components which may be present together with the repeating unit of the formula (II') may be any components of the monomer which is copolymerizable with the monomer corresponding to the repeating unit of the formula (II').

However, it is preferred that the A block does not contain the above-described components other than the repeating unit of the formula (II') and, if any, such other components are used at a proportion below 20 parts by weight per 100 parts by weight of the total polymer components in the A block. If the proportion of such other components exceeds 20 parts by weight, the dispersion stability of the resulting dispersed resin grains deteriorates.

The repeating unit represented by the formula (II') in the A block may be a combination of two or more of repeating units.

Then, the polymer components constituting the B block of the AB block copolymer used in the present invention is described hereinafter in detail.

The B block is composed of the polymer component corresponding to the monofunctional monomer (A) and/or the polymer component containing the above-described specific polar group.

The polymer components corresponding to the monofunctional monomer (A) include those described above fur the monomer (A) to be insolubilized. In this case, the polymer components are preferably composed of the same monomer as the monofunctional monomer (A) which forms the resin grain dispersion.

The polar groups

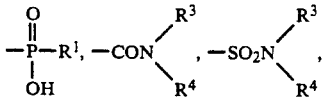

and the cyclic acid anhydride-containing group contained in the B block of the AB block copolymer of the dispersion-stabilizing resin (P') are the same as those described for the dispersion-stabilizing resin (P).

Of the polar groups in the B block, the amino group represents $-NH_2$, $-NHR^5$ or

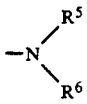

wherein $R^5$ and $R^6$, which may be the same or different, each represents a hydrocarbon group having 1 to 10 carbon atoms, preferably 1 to 7 carbon atoms, and specific examples thereof are those described above for the hydrocarbon groups represented by $R^2$.

More preferably, the hydrocarbon groups of $R^2$, $R^5$ and $R^6$ include an alkyl group having 1 to 4 carbon atoms which may be substituted, a benzyl group which may be substituted, and a phenyl group which may be substituted.

The monomer corresponding to the polymer component containing the above-described specific polar group can be any monofunctional monomer containing at least one of these polar groups. Examples of such monomerS are described, e.g., in Kobunshi Gakkai (ed.), *Kobunshi Data Handbook (Kisohen)*, Baifukan (1986). Specific examples of these monomers include acrylic acid, α- and/or β-substituted acrylic acids (e.g., α-acetoxy, α-acetoxymethyl, α-(2-amino)methyl, α-chloro, α-bromo, α-fluoro, α-tributylsilyl, α-cyano, β-chloro, β-bromo, α-chloro-β-methoxy, and α,β-dichloro compounds), methacrylic acid, itaconic acid, itaconic half esters, itaconic half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic half esters, maleic half amides, vinylbenzenecarboxylic acid, vinylbenzenesulfonic acid, vinylsulfonic acid, vinylphosphonic acid, dicarboxylic acid vinyl or allyl half esters, and ester or amide derivatives of these carboxylic acids or sulfonic acids containing the polar group in the substituent thereof.

Specific examples of these compounds are set forth below, but the present invention should not be construed as being limited thereto. In the following formulae, e represents —H, $-CH_3$, —Cl, —Br, —CN, $-CH_2COOCH_3$ or $-CH_2COOH$, f represents —H or $-CH_3$, m represents an integer of 2 to 10, m represents an integer of 1 to 10, p represents an integer of 1 to 4, $X_1$ represents —COOH,

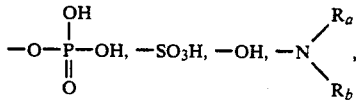

-continued

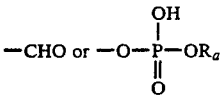

(wherein $R_a$ and $R_b$, each represents an alkyl group having 1 to 4 carbon atoms), and $X_2$ represents —COOH or —OH.

(A)-1

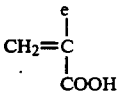

(A)-2

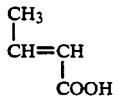

(A)-3

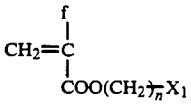

(A)-4

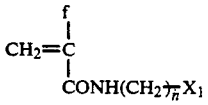

(A)-5

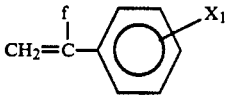

(A)-6

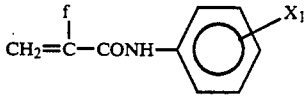

(A)-7

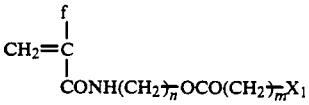

(A)-8

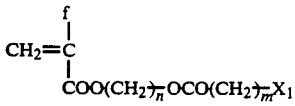

(A)-9

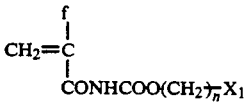

(A)-10

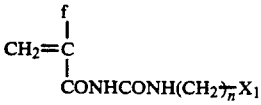

(A)-11

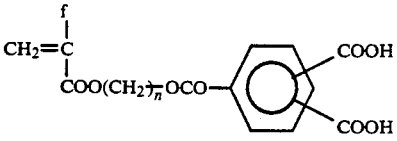

-continued (A)-12

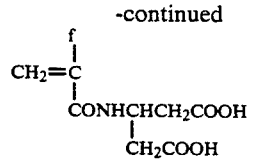

(A)-13

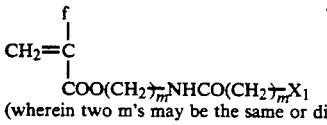

(wherein two m's may be the same or different)

(A)-14

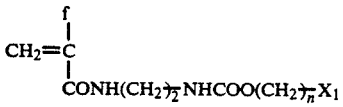

(A)-15

(A)-16

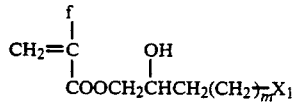

(A)-17

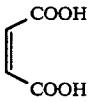

(A)-18

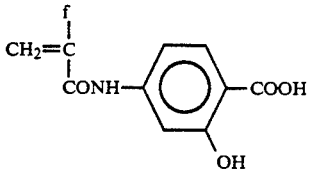

(A)-19

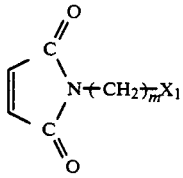

(A)-20

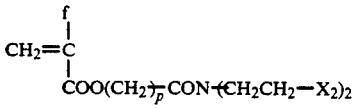

The AB type block copolymer used in the present invention can be produced by a conventionally known polymerization reaction method. More specifically, it can be produced by the method comprising previously protecting the polar group of a monomer corresponding to the polymer component having the specific polar group to form a functional group, synthesizing an AB type block copolymer by an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a so-called known living polymerization reaction such as a group transfer polymerization reaction, etc., and then conducting a protection-removing reaction of the functional group formed by protecting the polar group by a hydrolysis reaction, hydrogenolysis reaction, an oxidative decomposition reaction, or a photodecomposition reaction to form the polar group.

One of the examples is shown by the following reaction scheme (1):

Reaction Scheme (1)

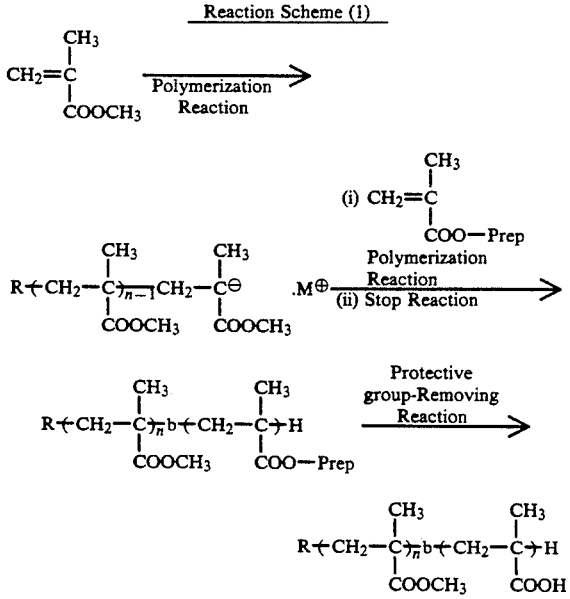

The above-described compounds can be easily synthesized according to the synthesis methods described, e.g., in P. Lutz, P. Masson et al, *Polym. Bull.*, 12, 79 (1984 ), B. C. Anderson, G. D. Andrews, et al, *Macromolecules*, 14, 1601 (1981), K. Hatada,, K. Ute, et al, *Polym. J.*, 17, 977 (1985), ibid., 18, 1037 (1987), Koichi Migite and Koichi Hatada, *Kobunshi Kako*, 36, 366 (1987), Toshinobu Higashimura and Mitsuo Sawamoto, *Kobunshi Ronbun Shu (Polymer Treatieses)*, 46, 189 (1989), M. Kuroki and T. Aida, *J. Am. Chem. Soc.*, 109, 4737 (1989), Teizo Aida and Shohei Inoue, *Yuki Gosei Kagaku (Organic Synthesis Chemistry)*, 43, 300 (1985), and D. Y. Sogah, W. R. Hertler et al, *Macromolecules*, 20, 1473 (1987).

Furthermore, the AB block copolymer can be also synthesized by a photoinitiator polymerization method using the monomer having the unprotected polar group and also using compound containing a dithiocarbamate group or a xanthate group as an initiator. For example, the block copolymers can be synthesized according to the synthesis methods described in Takayuki Otsu, *Kobunshi (Polymer)*, 37, 248 (1988), Shunichi Himori and Ryuichi Ohtsu, *Polym. Rep. Jap.* 37, 3508 (1988), JP-A-64-111, and JP-A-1-26619, Nobuyuki Higashi et al, *Polymer Preprints, Japan*, 36 (6), 1511 (1987), M. Niwa, N. Higashi et al, *J. Micromol. Sci. Chem. A* 24 (5), 567 (1987).

Also, the protection of the specific polar group of the present invention and the removal of the protective group (a reaction for removing a protective group) can be easily conducted by utilizing conventionally known knowledges, such as the methods described, e.g., in Yoshio Iwakura and Keisuke Kurita, *Hannosei Kobunshi (Reactive Polymer)*, published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973).

Further, the AB block copolymer can be synthesized by preparing an azobis compound containing either A block or B block (i.e., a high molecular weight azobis polymerization initiator), and polymerizing the resulting compound as a polymerization initiator with the monomers which form another block by a radical polymerization reaction. Specifically, the AB block copolymer can be synthesized according to the procedure as described, for example, in Akira Ueda and Susumu Nagai, *Kobunshi Ronbunshu*, 44, 469 (1987); and Akira Ueda, *Osaka City Industrial Laboratory Report*, 84, (1987).

In synthesizing the AB block copolymer by using the above reaction, the weight average molecular weight of the high molecular weight azobis polymerization initiator is preferably not more than $2\times10^4$ from the standpoint of ease in synthesis of the high molecular weight azobis polymerization initiator and the regularity in block polymerization reaction. On the other hand, in the dispersion-stabilizing resin (P), it is preferred that the B block has a longer polymer chain than that of the A block. For this reason, in synthesizing the AB block copolymer by the above reaction, it is preferred to use a high molecular weight azobis polymerization initiator containing the A block. For example, the AB block copolymer can be synthesized according to the following Reaction Scheme (2).

Reaction Scheme (2)

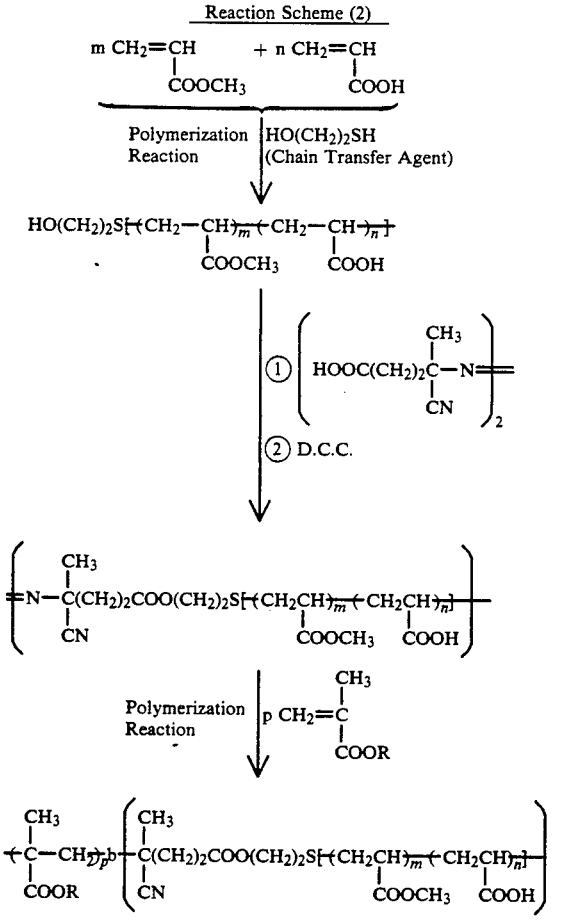

In the dispersion-stabilizing resin (P') used in the present invention, the B block preferably has the same polar group as that contained in the B block, at one terminal of the polymer main chain which is the terminal opposite to the terminal adjacent to the A block. The resin of this type is hereinafter referred to as dispersion-stabilizing resin (PA') or resin (PA').

Examples of the polar groups bonded to one terminal of the B block are those described for the polar groups contained in the B block. Also, as described above, the polar group bonded to one terminal of the B block is the same polar group as that contained in the B block. For example, when the B block has a plurality of different polar groups, the polar group bonded to one terminal of the B block is at least one selected from such a plurality of different polar groups.

In the dispersion-stabilizing resin (PA'), at least one specific polar group described above may be bonded to one terminal of the polymer main chain of the B block directly or via an appropriate linking group. Examples of the linking group are the same as those described for the dispersion-stabilizing resin (PA).

Further, a preferred embodiment of the dispersion-stabilizing resin (P') is a resin having a polymerizable functional group which is copolymerizable with the monomer (A) bonded to at least one terminal of the polymer main chain of the B block opposite to the terminal adjacent to the A block. (The resin of this type is hereinafter referred to as dispersion-stabilizing resin (PB') or resin (PB').)

Examples of the polymerizable functional group of the dispersion-stabilizing resin (PB') include the functional group represented by the general formula (V) described for the polymerizable functional group in the above-described polyfunctional monomer (D).

Also, the polymerizable functional group may be bonded to one terminal of the polymer main chain of the B block directly or via an appropriated linking group. The linking group can be the same as that described for the dispersion-stabilizing resin (PA').

The weight average molecular weight of the dispersion-stabilizing resin (P') of the present invention is preferably from $1\times10^4$ to $5\times10^5$, and more preferably from $2\times10^4$ to $1\times10^5$. If the weight average molecular weight is below $1\times10^4$, the average grain diameter of the resin grain obtained by the polymerization-granulation becomes large (e.g. more then 0.5 μm) and the distribution of the grain diameter becomes broad. Also, if it exceeds $5\times10^5$, the average grain diameter of the resin grain obtained by the polymerization-granulation becomes large thereby making it difficult to obtain grains having a uniform average grain diameter within a preferred range of from 0.15 to 0.4 μm.

The dispersion-stabilizing resin (P') used in the present invention is soluble in an organic solvent and, specifically, it may have a solubility of at least 5 parts by weight per 100 parts by weight of toluene at 25° C.

The dispersion-stabilizing resin (PA') having a specific polar group bonded to one terminal of the polymer main chain of the B block which is a preferred embodiment of the present invention can be easily prepared by an ion polymerization process, in which a various kind of reagents is reacted at the terminal of a living polymer obtained by conventionally known anion polymerization or cation polymerization, at the termination reaction of the living polymer, as shown in Reaction Scheme (1); or by the polymerization using, as a polymerization initiator, a dithiocarbamate group or xanthate group-containing compound (a polymerization initiator) which is used in the above-described photopolymerization and which contains the specific polar group of the present invention.

More specifically, reference can be made to literature references cited in the synthetic method for the dispersion-stabilizing resin (P').

The weight average molecular weight of the dispersion-stabilizing resin (PA') of the present invention is preferably from $1\times10^4$ to $5\times10^5$, and more preferably from $2\times10^4$ to $1\times10^5$. If the weight average molecular weight is below $1\times10^4$, the average grain diameter of the resin grain obtained by the polymerization-granulation becomes large (e.g., more then 0.5 μm) and the distribution of the grain diameter becomes broad. Also, if it exceeds $5\times10^5$, the average grain diameter of the resin grain obtained by the polymerization-granulation becomes large thereby making it difficult to obtain grains having a uniform average grain diameter within a preferred range of from 0.15 to 0.4 μm.

Further, the dispersion-stabilizing resin (PB') having a polymerizable double bond group bonded to at least one terminal of the polymer main chain of the B block which is a preferred embodiment of the present invention can be easily be prepared by reacting a reagent containing a double bond group with a living polymer obtained by the conventional artion polymerization or cation polymerization at the terminal of the living polymer, or by reacting a reagent containing a specific reactive group (e.g., —OH, —COOH, —$SO_3H$, —SH, —$NH_2$, —$PO_3H_2$, —NCO, —NCS, an epoxy group

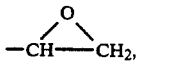

—COCl, and —$SO_2Cl$) with the living polymer at the terminal an then introducing a polymerizable double bond group by polymer reaction (i.e., a method by ion polymerization), or by performing a radical polymerization using a polymerization initiator and/or a chain transfer agent containing the above specific reactive group in the molecule and then introducing a polymerizable double bond group thereto by performing a polymer reaction utilizing the specific reactive group bonded to only one terminal of the polymer main chain.

Practically, the polymerizable double bond group can be introduced into the polymer according to the methods described in P. Dreyfuss & R. P. Quirk, *Encycl. Polymer Sci. Eng.*, 7, 551 (1987), Yoshiki Nakajo and Yuya Yamashita, *Senryo to Yakuhin (Dyes and Chemicals)*, 30, 232 (1985), Akira Ueda and Susumu Nagai, *Kagaku to Kogyo (Science and Industry)*, 60 (1986), P. F. Rempp & E. Franta, *Advances in Polymer Science*, 58, 1 (1984), Koichi Ito, *Kobunshi Kako (Polymer Processing)*, 35, 262 (1986), V. Percec, *Applied Polymer Science*, 35, 97 (1985) and the literature references cited therein.

More specifically, a method for introducing the polymerizable double bond group by polymer reaction using the specific polar group of the dispersion-stabilizing resin (PA') is preferred.

The dispersion resin gains (latex grains) used in the present invention can be generally produced by heat-polymerizing the above-described dispersion-stabilizing resin (P) or (P'), the monofunctional monomer (A), the monomer (C) containing a specific substituent, and the polyfunctional monomer (D), in a non-aqueous solvent in the presence of a polymerization initiator such as benzoyl peroxide, azobis-isobutyronitrile, butyl-lithium, etc.

Practically, the dispersion resin grains can be produced by (1) a method of adding the polymerization initiator to a solution of a mixture of the dispersion-stabilizing resin, and the monomers (A), (C) and (D), (2) a method of adding dropwise the monomers (A), (C) and (D), together with the polymerization initiator to a solution of the dispersion-stabilizing resin, (3) a method of adding the polymerization initiator and a part of a mixture of the monomers (A), (C) and (D) to a solution of the total amount of the dispersion-stabilizing resin and the remaining monomers (A), (C) and (D), (4) a method of adding a solution of the dispersion-stabilizing resin and the monomers (A), (C) and (D) together with the polymerization initiator to a non-aqueous solvent.

The total amount of the monomers (A), (C) and (D) is from about 5 to 80 parts by weight, and preferably from 10 to 50 parts by weight per 100 parts by weight of the non-aqueous solvent.

Also, the amount of the dispersion-stabilizing resin (P) or (P') (dispersion stabilizer) which is a soluble resin is from 1 to 100 parts by weight, and preferably from 10 to 50 parts by weight, more preferably from 10 to 50 parts by weight per 100 parts by weight of the total amounts of monomers (A), (C) and (D).

A suitable amount of the polymerization initiator is from 0.1 to 5% by weight of the total amount of the monomers (A), (C) and (D).

The polymerization temperature is from about 50° C. to 180° C., and preferably from 60° C. to 120° C. The reaction time is preferably from 1 to 15 hours.

When a polar solvent such as alcohols, ketones, ethers, esters, etc., is used together with the non-aqueous solvent for the above-described reaction or when unreacted monomer (A), (C) and/or (D) remain without being polymerization-granulated, it is preferred to remove the polar solvent or the unreacted monomers by heating the reaction mixture to the boiling point of the solvent or the monomers to distil off them or distil off the solvent or the monomers under reduced pressure.

The latex grains dispersed in a non-aqueous solvent thus produced exist as fine grains having a uniform grain size distribution and show a very stable dispersibility. In particular, when the liquid developer composed of the latex grains are repeatedly used in a developing device for a long period of time, the dispersibility thereof is good and the occurrence of stains by adhesion of the grains onto each part of the developing device is not observed.

Also, when the latex grains are fixed by heating, etc., a strong coating or layer having an excellent fixing property can be formed.

Further, the liquid developer of the present invention, when used in the plate-making system, shows excellent resistivity of the toner image after subjecting to the treatment for hydrophilization of the non-image area, and shows excellent reproducibility of the original image in the image area of prints.

The insoluble resin grain of the present invention has an improved monodispersibility and redispersibility of grains by polymerization-granulation using the monomer (C) and the dispersion-stabilizing resin (P) or (P').

That is, the monomer (C) is copolymerized with the monomer (A) to be insolubilized in the polymerization-granulation in a non-aqueous solvent to form resin grains, and the specific substituent moiety contained in the monomer (C) in designed to have a good affinity for the non-aqueous solvent. Thus, the specific substituent moiety is oriented in the boundary (surface) portion of the grain structure rather than being buried in the inside of the grain structure due to its good solvation to the dispersion solvent. As a result, it is considered that the affinity of the grain surface for the dispersion solvent is improved and an effect for preventing aggregation of grains is markedly increased.

Also, in the dispersed resin grain of the present invention, the dispersion-stabilizing resin (P) shows an interaction with an insoluble resin grain and is adsorbed on the insoluble resin grain. Since the dispersion-stabilizing resin adsorbed on the resin grain is soluble in the non-aqueous solvent, it brings about a so-called steric repulsive effect which is known to be effective for dispersion stabilizing of non-aqueous latex. Further, since the dispersion-stabilizing resin (P) is a soluble resin having a crosslinked structure, it has markedly improved affinity to the non-aqueous solvent, and the adsorbed resin (P) exists near the boundary surface of grains due to its crosslinked structure and is considered to improve the solvation near the boundary surface of the resin grains.

On the other hand, the dispersion-stabilizing resin (P') of the present invention is characterized by being an AB block copolymer comprising the A block composed of polymer components containing a long chain aliphatic group which has a high affinity for the non-aqueous solvent and the B block composed of polymer components having a low affinity for the non-aqueous solvent and having a high affinity for the monomer (A) to be insolubilized.

Due to the above structure features of the AB block copolymer, it is considered that the B block is well adsorbed onto the dispersed resin grain by physical and chemical interaction during the polymerization-granulation, while the A block having a high affinity for the non-aqueous solvent is well solvated with the solvent and well produces the steric repulsive effect (i.e., adsorbed in the tail form) thereby achieving the effect of the present invention.

The above characteristic features of the resins according to the present invention are considered to markedly inhibit aggregation and precipitation of insoluble resin grains and markedly improve the redispersibility of the resin grains.

In the present invention, when the dispersion-stabilizing resin (PA) or (PA') containing a specific polar group bonded to at least one terminal of the polymer main chain, which is a preferred embodiment of the present invention, is used, it is considered that an interaction between the dispersion-stabilizing resin and the insoluble resin grain is further improved and the effect for the dispersion stabilization described above is further improved due to high adsorbability of the resin (PA) or (PA') onto the resin grains.

When the dispersion-stabilizing resin (PB) or (PB') containing a polymerizable functional group bonded to at least one terminal of the polymer main chain, which is a further preferred embodiment of the present invention, the resin (PB) or (PB') is copolymerized with the monomer (A) to be insolubilized, the monomer (C) and the monomer (D) during the dispersion-polymerization whereby the resin is bonded to the insoluble resin grain more effectively.

As described above, the use of the dispersion-stabilizing resin (P) or (P') improves the dispersion stability, and the additional use of the dispersion-stabilizing stabilizing resin (PA), (PA'), (PB) or (PB') provides the same degree of effects with a smaller amount of the dispersion-stabilizing resin and reduces the amount of resin (P) or (P') which is not adsorbed onto the resin grain. This eliminates various problems caused by the concentration of the unadsorbed dispersion stabilizing resin during the repeated use of the liquid developer for a long period of time.

On the other hand, the insoluble resin grain of the present invention is characterized by a crosslinked structure formed by polymerization-granulation using the polyfunctional monomer (D).

Due to the crosslinked structure, it is possible to improve the resistivity to the treating solution (resistivity) after forming a toner image and subjecting to the hydrophilization prbcessing for making a printing master plate, and to reduce markedly the damage of the toner image portion.

Also, it is important from the standpoint of apparatus that the insoluble resin grain has a low glass transition point in order to fix the resin under mild conditions. The resins having a low glass transition point generally can be obtained by incorporating a polar structure such as an ester structure, an ether structure or an amido structure so as to be easily dissolved in the treating solution in the hydrophilization processing and, as a result, the toner portion on the image area has low resistivity. This undesirable phenomenon can be markedly suppressed by partially crosslinking the inside of the resin grain.

The dispersed resin grain of the present invention brings about the effect of the present invention by the above-described actions.

The liquid developer of the present invention may contain, if desired, a colorant. There is no specific restriction on the colorant being used, and any conventional pigments or dyes can be used as the colorant in the present invention.

In the case of coloring the dispersion resin itself, there is, for example, a method of coloring the dispersion resin by physically dispersing a pigment or dye in the dispersion resin and various pigments and dyes can be used. For example, there are a magnetic iron oxide powder, a lead iodide powder, carbon black, nigrosine, Alkali Blue, Hansa Yellow, quinacridone red, phthalocyanine blue, etc.

As another method of coloring the dispersion resin grains, the dispersion resin may be dyed with a desired dye, for example, as disclosed in JP-A-57-48738. As still other method, a dye may be chemically bonded to the dispersion resin as disclosed, for example, in JP-A-53-54029 or a previously dye-containing monomer is used in the polymerization granulation to provide a dye-containing dispersion resin as disclosed, for example, in JP-B-44-22955. (The term "JP-B" as used herein means an "examined Japanese patent publication".).

Various additives may be added to the liquid developer for enhancing the charging characteristics or improving the image characteristics and they are practically described in Yuji Harasaki, *Electrophotography*, Vol. 16, No. 2, page 44.

Specific examples of these additives include metal salts of 2-ethylhexylsulfosuccinic acid, metal salts of naphthenic acid, metal salts of higher fatty acids, lecithin, poly(vinylpyrrolidone), copolymers containing a semi-maleic acid amide component, higher alcohols, polyethers and waxes, but the present invention is not limited thereto.

The amounts of the main constituting components of the liquid developer of the present invention are further described below.

The amount of the toner grains consisting essentially of the dispersion resin and, if desired, a colorant is preferably from about 0.5 to 50 parts by weight per 1,000 parts by weight of the liquid carrier. If the amount thereof is less than about 0.5 part by weight, the image density formed is sufficient and, if the amount exceeds about 50 parts by weight, non-image portions are liable to be fogged. Further, the above-described liquid carrier-soluble resin for enhancing the dispersion stability may also be used, if desired, in an amount of from about 0.5 by weight to about 100 parts by weight per 1,000 parts by weight of the liquid carrier. Also, the charge-controlling agent as described above can be used preferably in an amount of from 0.001 part by weight to 1.0 part by weight per 1,000 parts by weight of the liquid carrier.

Furthermore, if desired, various additives may be added to the liquid developer and the total amount of these additives is restricted by the electric resistance of the liquid developer. That is, if the electric resistance of the liquid developer in a state of excluding the toner grains therefrom becomes lower than $10^9$ Ωcm, continuous tone images having good image quality are reluctant to obtain and, hence, it is necessary to control the amounts of additives in the aforesaid range of not lowering the electric resistance than $10^9$ Ωcm.

Then, the following examples are intended to illustrate the embodiments of this invention in detail but not to limit the scope of the present invention in any way.

PRODUCTION EXAMPLE 1 OF DISPERSION-STABILIZING RESIN (P): P-1

A mixed solution of 100 g of octadecyl methacrylate, 1.0 g of divinylbenzene and 200 g of toluene was heated to a temperature of 85° C. under nitrogen gas stream while stirring. 3.0 g of 2,2'-azobisisobutyronitrile (abbreviated as AIBN) was added thereto, followed by reacting for 4 hours, and 1.0 g of AIBN was further added thereto, followed by reacting for 2 hours. After cooling, the mixture was reprecipitated from 1.5 liter of methanol, and the resulting powder was collected by filtration and dried to obtain 88 g of the polymer as a white powder. The resulting polymer had a weight average molecular weight (abbreviated as Mw) of $3.3\times10^4$.

PRODUCTION EXAMPLES 2 TO 14 OF DISPERSION-STABILIZING RESIN (P): P-2 TO P-14

Each of the dispersion-stabilizing resins was prepared in the same manner as described in Production Example 1 of Dispersion-Stabilizing Resin (P) except for using Monomer (A) and Monomer (D) shown in Table 1 below in place of octadecyl methacrylate and divinylbenzene.

Each of the resulting resins had an Mw in the range of from $3.0\times10^4$ to $5\times10^4$.

TABLE 1

| Production Example | Dispersion-Stabilizing Resin (P) | Monomer (A) | | Monomer (D) | |
|---|---|---|---|---|---|
| 2 | P-2 | Dodecyl methacrylate | 100 g | Divinylbenzene | 0.8 g |
| 3 | P-3 | Tridecyl methacrylate | 100 g | Divinylbenzene | 0.7 g |
| 4 | P-4 | Octyl methacrylate | 20 g | Trivinylbenzene | 0.5 g |
| | | Dodecyl methacrylate | 80 g | | |
| 5 | P-5 | Octadecyl methacrylate | 70 g | Ethylene glycol dimethacrylate | 1.5 g |
| | | Butyl methacrylate | 30 g | | |
| 6 | P-6 | Dodecyl methacryalte | 95 g | Ethylene glycol diacrylate | 0.9 g |
| | | N,N-Dimethylaminoethyl methacrylate | 5 g | | |
| 7 | P-7 | Octadecyl methacrylate | 96 g | Vinyl methacrylate | 1.2 g |
| | | 2-(Trimethoxysilyloxy)ethyl methacrylate | 4 g | | |
| 8 | P-8 | Hexadecyl methacrylate | 100 g | Divinylbenzene | 0.8 g |
| 9 | P-9 | Tetradecyl methacrylate | 100 g | Allyl methacrylate | 3.0 g |
| 10 | P-10 | Octadecyl methacrylate | 95 g | Diethylene glycol dimethacrylate | 2.5 g |
| | | Methacrylic acid | 5 g | | |
| 11 | P-11 | Dodecyl methacrylate | 90 g | Divinyl adipate | 4.0 g |
| | | Vinyl acetate | 10 g | | |
| 12 | P-12 | Octadecyl methacrylate | 92 g | Triethylene glycol diacrylate | 3.0 g |
| | | 2-Hydroxyethyl methacrylate | 8 g | | |
| 13 | P-13 | Dodecyl methacrylate | 80 g | Divinylbenzene | 0.9 g |
| | | Styrene | 20 g | | |
| 14 | P-14 | Dodecyl methacrylate | 92 g | Trimethylolpropane trimethacrylate | 3.5 g |
| | | N-Vinylpyrrolidone | 8 g | | |

PRODUCTION EXAMPLE 1 OF DISPERSION-STABILIZING RESIN (PA): PA-1

A mixed solution of 97 g of octadecyl methacrylate, 3 g of thioglycolic acid, 5.0 g of divinylbenzene and 200 g of toluene was heated at a temperature of 85° C. under nitrogen gas stream while stirring. 0.8 g of 1,1'-azobis(-cyclohexane-1-carbonitrile) (abbreviated as ACHN) was added thereto, followed by reacting for 4 hours, and 0.4 g of ACHN was further added thereto, followed by reacting for 2 hours. Further, 0.2 g of ACHN was added thereto, followed by reacting for 2 hours. After cooling, the mixture was reprecipitated from 1.5 liter of methanol, and the resulting powder was collected by filtration and dried to obtain 88 g of the polymer as a white powder. The resulting polymer had an Mw of $3\times10^4$.

PRODUCTION OF EXAMPLES 2 TO 9 OF DISPERSION-STABILIZING RESIN (PA): PA-2 TO PA-9

Each of the dispersion-stabilizing resins was prepared in the same manner as described in Production Example 1 of Dispersion-Stabilizing Resin (PA) except for using Monomer (A) and Monomer (D) shown in Table 2 below in place of octadecyl methacrylate and divinylbenzene.

Each of the resulting resins had an Mw in the range of from $2.5\times10^4$ to $4\times10^4$.

TABLE 2

| Production Example | Dispersion-Stabilizing Resin (PA) | Monomer (A) | | Monomer (D) | |
|---|---|---|---|---|---|
| 2 | PA-2 | Dodecyl methacrylate | 97 g | Divinylbenzene | 6 g |
| 3 | PA-3 | Tridecyl methacrylate | 97 g | Divinylbenzene | 4 g |
| 4 | PA-4 | Octadecyl methacrylate | 17 g | Trivinylbenzene | 2.5 g |
| | | Dodecyl methacrylate | 80 g | | |
| 5 | PA-5 | Octadecyl methacrylate | 70 g | Ethylene glycol dimethacrylate | 8 g |
| | | Butyl methacrylate | 27 g | | |
| 6 | PA-6 | Dodecyl methacrylate | 92 g | Vinyl methacrylate | 10 g |
| | | N,N-dimethylaminoethyl methacrylate | 5 g | | |
| 7 | PA-7 | Octadecyl methacrylate | 93 g | Triethylene glycol diacrylate | 7 g |
| | | 2-(Trimethoxysilyloxy)ethyl methacrylate | 4 g | | |
| 8 | PA-8 | Hexadecyl methacrylate | 97 g | Divinyl adipate | 11 g |
| 9 | PA-9 | Tetradecyl methacrylate | 97 g | Polyethylene glycol #400 diacrylate | 12 g |

PRODUCTION EXAMPLE 10 OF DISPERSION-STABILIZING RESIN (PA): PA-10

A mixed solution of 97 g of octadecyl methacrylate, 3 g of thiomalic acid, 4.5 g of divinylbenzene, 150 g of toluene and 50 g of methanol was reacted at a temperature of 60° C. for 5 hours under nitrogen gas stream while stirring. 0.5 g of AIBN was added thereto, followed by reacting for 3 hours, and 0.3 g of AIBN was further added thereto, followed by reacting for 3 hours. After cooling, the mixture was reprecipitated from 2 liters of methanol, and the resulting powder was collected by filtration and dried to obtain 85 g of the polymer as a white powder. The resulting polymer had an Mw of $3.5\times10^4$.

PRODUCTION EXAMPLES 11 TO 16 OF DISPERSION-STABILIZING RESIN (PA): PA-11 TO PA-16

Each of the dispersion-stabilizing resins was prepared in the same manner as described in Production Example 10 of Dispersion-Stabilizing Resin (PA) except for using a mercapto compound shown in Table 3 below in place of 3 g of thiomalic acid.

TABLE 3

| Production Example | Dispersion-Stabilizing Resin (PA) | Mercapto Compound | Mw of Dispersion-Stabilizing Resin (PA) |
|---|---|---|---|
| 11 | PA-11 | $HS-CH_2CH_2COOH$ | $3.6\times10^4$ |
| 12 | PA-12 | $HS-CH_2CH_2SO_3H.N$ 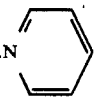 | $2.9\times10^4$ |
| 13 | PA-13 | 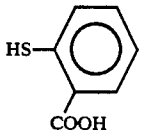 | $3.8\times10^4$ |
| 14 | PA-14 | $HS-CH_2CH_2-O-\overset{\overset{O}{\|}}{\underset{\underset{OH}{\|}}{P}}-OH$ | $3.3\times10^4$ |
| 15 | PA-15 | $HS-CH_2CH_2NHCO(CH_2)_2COOH$ | $3.7\times10^4$ |
| 16 | PA-16 | $HS-CH_2CH_2NHCH_2CH_2COOH$ | $3.5\times10^4$ |

PRODUCTION EXAMPLE 17 OF DISPERSION-STABILIZING RESIN (PA): PA-17

A mixture of 94 g of hexadecyl methacrylate, 0.5 g of divinylbenzene, 150 g of toluene and 50 g of isopropyl alcohol was heated at a temperture of 90° C. under nitrogen stream, and 6 g of 2,2'-azobis(4-cyanovaleric acid) (abbreviated as ACV) was added thereto, followed by reacting for 8 hours. After cooling, the reaction mixture was reprecipitated from 1.5 liter of methanol, and the resulting polymer as a powder was collected by filtration and dried to obtain 83 g of a white powder.

The resulting polymer had an Mw of $6.5\times10^4$.

PRODUCTION EXAMPLE 18 OF DISPERSION-STABILIZING RESIN (PA): PA-18

A mixture of 92 g of docosanyl methacrylate, 1.5 g of ISP-22GA (manufactured by Okamura Seiyu KK), 150 g of toluene and 50 g of ethanol was heated at a temperature of 80° C. under nitrogen stream, and 8 g of 4,4'-azobis(4-cyanopentanol) was added thereto, followed by reacting for 8 hours. After cooling, the reaction mixture was reprecipitated from 1.5 liter of methanol, and the resulting polymer as a powder was collected by filtration and dried to obtain 78 g of a white powder.

The resulting polymer had an Mw of $4.1\times10^4$.

PRODUCTION EXAMPLE 19 OF DISPERSION-STABILIZING RESIN (PA): PA-19

A mixed solution of 95 g of octadecyl methacrylate, 5 g of 2-mercaptoethylamine, 5 g of divinylbenzene and 200 g of toluene was heated at a temperature of 85° C.

under nitrogen stream, and, after adding 0.7 g of ACHN, the mixture was reacted for 8 hours.

Then, 8 g of glutaconic anhydride and 1 ml of concentrated sulfuric acid were added to the reaction mixture, followed by reacting for 8 hours. After cooling, the reaction mixture was reprecipitated from 1.5 liter of methanol, and the resulting powder was collected by filtration and dried to obtain 83 g of a polymer as a white powder.

The resulting polymer had an Mw of $3.1\times10^4$.

PRODUCTION EXAMPLE 1 OF DISPERSION-STABILIZING RESIN (PB): PB-1

A mixed solution of 50 g of Resin PA-1 prepared in Production Example 1 of Dispersion-Stabilizing Resin (PA), 5 g of allyl alcohol and 100 g of tetrahydrofuran was adjusted to a temperature of 25° C. while stirring. To the solution was added dropwise a mixed solution of 8 g of dicyclohexylcarbodiimide (abbreviated as DCC), 0.2 g of 4-(N,N-diethylamino)pyridine and 20 g of methylene chloride over one hour. The mixture was allowed to react for 3 hours to complete the reaction. Then, 10 g of 80% formic acid was added to the reaction mixture, and, after stirring for one hour, insoluble materials were filtered off. The filtrate was reprecipitated from one liter of methanol, and the precipitate was collected by filtration and again dissolved in 90 g of toluene. After filtering off insoluble materials, the filtrate was reprecipitated from 500 ml of methanol, and the precipitate was collected by filtration and dried.

The yield of the resulting polymer was 32 g, and the polymer had an Mw of $3\times10^4$.

PRODUCTION EXAMPLES 2 TO 16 OF DISPERSION-STABILIZING Resin (PB): PB-2 to PB-16

Each of the dispersion-stabilizing resins was prepared in the same manner as described in Production Example 1 of Dispersion-Stabilizing Resin (PB) except for using Resin PA and the polymerizable group-introducing compound shown in Table 4 below in place of Resin PA-1 and allyl-alcohol.

TABLE 4

| Production Example | Dispersion-Stabilizing Resin (PB) | Resin (PA) | Polymerizable Group-Introducing Compound | Mw of Dispersion-Stabilizing Resin (PB) |
|---|---|---|---|---|
| 2 | PB-2 | PA-2 | Allyl alcohol | $3.2\times10^4$ |
| 3 | PB-3 | PA-3 | Allyl alcohol | $3.5\times10^4$ |
| 4 | PB-4 | PA-4 | Allyl alcohol | $3.5\times10^4$ |
| 5 | PB-5 | PA-15 | Allyl alcohol | $3.7\times10^4$ |
| 6 | PB-6 | PA-16 | 1-Propenyl alcohol | $4.2\times10^4$ |
| 7 | PB-7 | PA-5 | Allylamine | $3\times10^4$ |
| 8 | PB-8 | PA-1 | 2-Hydroxyethyl methacrylate | $3\times10^4$ |
| 9 | PB-9 | PA-2 | 2-Hydroxyethyl methacrylate | $3.3\times10^4$ |
| 10 | PB-10 | PA-2 | 2-Hydroxyethyl acrylate | $3.5\times10^4$ |
| 11 | PB-11 | PA-8 | Allylamine | $3.2\times10^4$ |
| 12 | PB-12 | PA-9 | 4-Hydroxymethyl styrene | $3\times10^4$ |
| 13 | PB-13 | PA-8 | 1-Propenyl alcohol | $3.2\times10^4$ |
| 14 | PB-14 | PA-9 | Propargyl alcohol | $3\times10^4$ |
| 15 | PB-15 | PA-11 | Allyl alcohol | $3.5\times10^4$ |
| 16 | PB-16 | PA-11 | 2-Hydroxyethyl methacrylate | $3.6\times10^4$ |

PRODUCTION EXAMPLE 17 OF DISPERSION-STABILIZING RESIN (PB): PB-17

A mixed solution of 94 g of octadecyl methacrylate, 3 g of 2-mercaptoethanol, 5 g of divinylbenzene 150 g of tetrahydrofuran and 50 g of ethanol was heated at a temperature of 70° C. under nitrogen stream, and 1 g of AIBN was added thereto, followed by reacting for 4 hours. Then, 0.5 g of AIBN was further added thereto, followed by reacting for 4 hours.

The reaction mixture was cooled to 25° C., and 8 g of vinyl acetate was added thereto. To the mixture was added dropwise a mixed solution of 10 g of DCC, 0.4 g of 4-(N,N-diethylamino)pyridine and 30 g of methylene chloride over one hour, followed by stirring for 4 hours.

Then, 5 g of a 30% ethanol solution of hydrogen chloride and 5 g of water were added to the reaction mixture, followed by stirring for 1 hour. After filtering off insoluble materials, the filtrate was reprecipitated from 2 liters of methanol, and the precipitate was collected by filtration and dried.

The resulting polymer had an Mw of $4\times10^4$.

PRODUCTION EXAMPLES 18 TO 25 OF DISPERSION-STABILIZING RESIN (PB): PB-18 TO PB-25

Each of the dispersion-stabilizing resins was prepared in the same manner as described in Production Example 17 of Dispersion-Stabilizing Resin (PB) except for using the polymerizable group-containing carboxylic acid compound shown in Table 5 in place of vinyl acetate.

Each of the resulting resins had an Mw of about $4\times10^4$.

TABLE 5

| Production Example | Dispersion-Stabilizing Resin (PB) | Polymerizable Group-Containing Carboxylic Acid Compound |
|---|---|---|
| 18 | PB-18 | Methacrylic acid |
| 19 | PB-19 | Acrylic acid |
| 20 | PB-20 | Crotonic acid |
| 21 | PB-21 | 4-Vinylbenzenecarboxylic acid |
| 22 | PB-22 | 3-Butenic carboxylic acid |
| 23 | PB-23 | $CH_2{=}C(CH_3)COO(CH_2)_2OCO(CH_2)_2COOH$ |
| 24 | PB-24 | $CH_2{=}CHCOO(CH_2)_2OCO(CH_2)_3COOH$ |
| 25 | PB-25 | $CH_2{=}CHCONH(CH_2)_{10}COOH$ |

PRODUCTION EXAMPLE 26 OF DISPERSION-STABILIZING RESIN (PB): PB-26

A mixture of 100 g of Resin PA-17 prepared in Production Example 17 of Dispersion-Stabilizing Resin (PA), 8 g of glycidyl methacrylate, 1.0 g of N,N-dimethyldodecylamine, 0.5 g of t-butylhydroquinone and 200 g of toluene was stirred at a temperature of 100° C. for 12 hours. After cooling, the reaction solution was reprecipitated in 1.5 liter of methanol, and the precipitate was collected by filtration and dried to obtain 78 g of a polymer as a pale yellow powder.

The resulting polymer had an Mw of $6.8\times10^4$.

PRODUCTION EXAMPLE 27 OF DISPERSION-STABILIZING RESIN (PB): PB-27

A solution of 100 g of Resin PA-18 prepared in Production Example 18 of Dispersion-Stabilizing Resin (PA) dissolved in 200 g of tetrahydrofuran was cooled in a water bath to a temperature of 20° C., and 10.2 g of triethylamine was added to the mixture. Then, 14.5 g of methacrylic acid chloride was added dropwise thereto while stirring at a temperature of 25° C. or below. After completion of the addition, the mixture was stirred for one hour. Thereafter, 0.5 g of t-butylhydroquinone was added thereto, and the mixture was heated to a temperature of 60° C. and stirred for 4 hours. After cooling, the mixture was added dropwise to one liter of water while stirring over about 10 minutes. The mixture was stirred for one hour followed by allowing to stand, and water was removed by decantation. After washing with water twice, the product was dissolved in 100 ml of tetrahydrofuran and reprecipitated from 2 liters of petroleum ether. The precipitate was collected by decantation and dried under reduced pressure.

The yield of the resulting viscous material was 65 g, and the Mw thereof was $4.5\times10^4$.

PRODUCTION EXAMPLE 1 OF DISPERSION-STABILIZING RESIN (P'): P'-1

A mixed solution of 95 g of dodecyl methacrylate, and 200 g of tetrahydrofuran was sufficiently degassed in a nitrogen stream and cooled to −78° C. Then, 1.0 g of 1,1-diphenylbutyl lithium was added to the mixture, and the reaction was conducted for 12 hours. Separately, a mixed solution of 5 g of triphenylmethyl methacrylate and 25 g of tetrahydrofuran was sufficiently degassed in a nitrogen stream, and the resulting mixed solution was added to the above described mixture, and then reaction was further conducted for 8 hours. After adjusting the temperature of the reaction mixture to 0° C., 10 ml of methanol was added to the mixture, followed by reacting for 30 minutes to terminate the polymerization reaction.

The temperature of the reaction solution obtained was raised to 30° C. under stirring, 15 ml of a 30 wt % ethanol solution of hydrogen chloride was added thereto, and the mixture was stirred for one hour. Then, the solvent of the reaction mixture was distilled off under reduced pressure until the whole volume was reduced to a half volume, and the mixture was reprecipitated. from one liter of methanol.

The precipitates thus formed were collected and dried under reduced pressure to obtain 70 g of a polymer (P'-1) shown below having a weight average molecular weight (Mw) of $4.5\times10^4$. (P'-1)

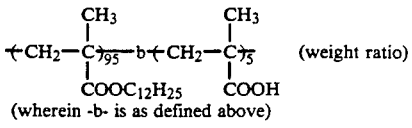

(P'-1)

PRODUCTION EXAMPLE 2 OF DISPERSION-STABILIZING RESIN (P'): P'-2

A mixed solution of 100 g of dodecyl methacrylate, and 200 g of tetrahydrofuran was sufficiently degassed in a nitrogen stream and cooled to −20° C. Then, 1.3 g of 1,1-diphenylbutyl lithium was added to the mixture, and the reaction was conducted for 12 hours. Separately, a mixed solution of 62 g of methyl acrylate, 12 g of triphenylmethyl methacrylate and 5 g of tetrahydrofuran was sufficiently degassed in a nitrogen stream, and the resulting mixed solution was added to the above described mixture, and then reaction was further conducted for 8 hours. After adjusting the temperature of the reaction mixture to 0° C., 10 ml of methanol was added to the mixture, followed by reacting for 30 minutes to terminate the polymerization reaction.

The temperature of the reaction solution obtained was raised to 30° C. under stirring, 3 ml of a 30 wt % ethanol solution of hydrogen chloride was added thereto, and the mixture was stirred for one hour. Then, the solvent of the reaction mixture was distilled off under reduced pressure until the whole volume was reduced to a half volume, and the mixture was reprecipitated from one liter of petroleum ether.

The precipitates thus formed were collected and dried under reduced pressure to obtain 78 g of a polymer (P'-2) shown below having a weight average molecular weight of $4.3\times10^4$.

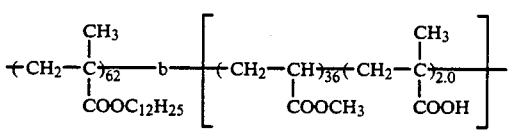

(P'-2)

PRODUCTION EXAMPLE 3 OF DISPERSION-STABILIZING RESIN (P'): P'-3

A mixed solution of 46 g of octadecyl methacrylate, 0.4 g of (tetraphenyl porphinate) aluminum methyl, and 60 g of methylene chloride was raised to a temperature of 30° C. in a nitrogen stream. The mixture was irradiated with light from a xenon lamp of 300 W at a distance of 25 cm through a glass filter, and the reaction was conducted for 12 hours. To the mixture was further added 4 g of benzyl methacrylate, after similarly light-irradiating for 8 hours, 3 g of methanol was added to the reaction mixture followed by stirring for 30 minutes, and then the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of methanol, and the precipitate thus formed was collected and dried to obtain 33 g of a polymer (P'-3) shown below having an Mw of $4\times10^3$.

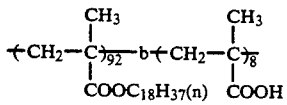

(P'-3)

PRODUCTION EXAMPLE 4 OF DISPERSION-STABILIZING RESIN (P'): P'-4

A mixed solution of 70 g of octadecyl methacrylate, 30 g of dodecyl acrylate, 0.5 g of (tetraphenyl porphinate) aluminum methyl, and 60 g of methylene chloride was raised to a temperature of 30° C. in a nitrogen stream. The mixture was irradiated with light from a xenon lamp of 300 W at a distance of 25 cm through a glass filter, and the reaction was conducted for 12 hours. To the mixture were further added 60 g of methyl acrylate and 9.3 g of trimethylsilyl methacrylate, after similarly light-irradiating for 8 hours, 3 g of methanol was added to the reaction mixture followed by stirring for 30 minutes, and then the reaction was terminated. Then, 10 g of a solution of methanol-water (95/5 by volume) containing 30 wt % of hydrogen chloride was added to the reaction mixture, followed by reacting for one hour at 25° C. to perform hydrolysis of the trimethylsilyl methacrylate component. The reaction mixture was reprecipitated from 1.5 liter of methanol, and the precipitate thus formed was collected and dried to obtain 70 g of a polymer (P'-4) shown below having an Mw of $5\times10^4$.

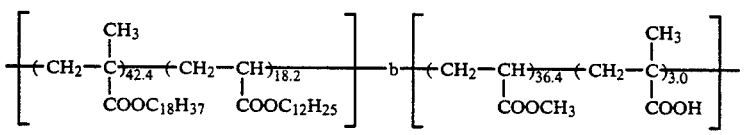

(P'-4)

PRODUCTION EXAMPLE 5 OF DISPERSION-STABILIZING RESIN (P'): P'-5

A mixed solution of 100 g of dodecyl methacrylate and 200 g of toluene was sufficiently degassed in a nitrogen stream and cooled to 0° C. Then, 2.5 g of 1,1-diphenyl-3-methylpentyl lithium was added to the mixture followed by stirring for 6 hours. Separately, a mixed solution of 30 g of methyl methacrylate and 4.6 g of 4-vinylphenyloxytrimethylsilane was added to the above described mixture, and then reaction mixture was stirred for 6 hours. Thereafter, 3 g of methanol was added thereto, followed by stirring for 30 minutes.

Then, to the reaction mixture was added 10 ml of a 30 wt % ethanol solution of hydrogen chloride and, after stirring the mixture for one hour at 25° C., the mixture was reprecipitated from one liter of methanol. The precipitates thus formed were collected, washed twice with 300 ml of methanol and dried to obtain 102 g of a polymer (P'-5) shown below having an Mw of $6\times10^4$.

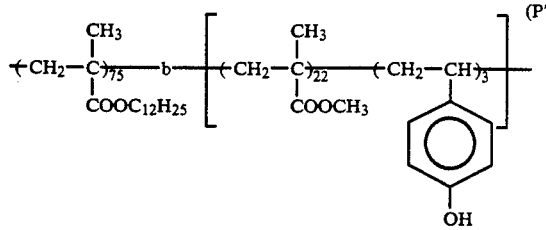

(P'-5)

PRODUCTION EXAMPLE 6 OF DISPERSION-STABILIZING RESIN (P'): P'-6

A mixture of 95 g of hexadecyl methacrylate and 2.0 g of benzyl N,N-dimethyldithiocarbamate was placed in a vessel in a nitrogen stream followed by closing the vessel and heated to 60° C. The mixture was irradiated with light from a high-pressure mercury lamp of 400 W at a distance of 10 cm through a glass filter for 6 hours to conduct a photopolymerization. After dissolving the reaction mixture in 100 g of tetrahydrofuran, 5 g of acrylic acid was added to the mixture and, after replacing the gas in the vessel with nitrogen, the mixture was light-irradiated again for 10 hours.

The reaction mixture was reprecipitated from 1.5 liters of methanol and the precipitates thus formed were collected and dried to obtain 68 g of a polymer (P'-6) shown below having an Mw of $3.5\times10^4$.

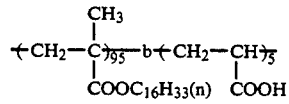

(P'-6)

PRODUCTION EXAMPLE 7 OF DISPERSION-STABILIZING RESIN (P'): P'-7

A mixed solution of 80 g of stearyl methacrylate and 200 g of tetrahydrofuran was sufficiently degassed in a nitrogen stream and cooled to −78° C. Then, 1.0 g of 1,1-diphenyl-3-methylpentyl potassium was added to the mixture, followed by stirring for 10 hours. Further, 20 g of styrene was added to the mixture, and the resulting mixture was stirred for 8 hours. The reaction mixture was adjusted to a temperature of 0° C., and 10 ml of methanol was added thereto. The mixture was reprecipitated from 1.5 liter of methanol, and the precipitate thus formed was collected by filtration and dried to obtain 68 g of a polymer (P'-7) shown below having an Mw of $3\times10^4$.

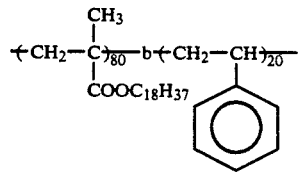

(P'-7)

PRODUCTION EXAMPLE 8 OF DISPERSION-STABILIZING RESIN (P'): P'-8

A mixed solution of 97 g of methyl acrylate, 3 g of methacrylic acid, 2 g of mercaptoethanol and 200 g of tetrahydrofuran was heated at a temperature of 60° C. while stirring in a nitrogen stream. To the mixture was then added 1.0 g of 2,2'-azobis(isovaleronitrile) (abbreviated as AIVN) followed by reacting for 4 hours. Then, 0.5 g of AIVN was further added thereto, followed by reacting for 4 hours.

After cooling the reaction mixture to a temperature of 20° C., 8.6 g of 4,4'-azobis(cyanovaleric acid), 12 g of dicyclohexylcarbodiimide and 0.2 g of 4-(N,N-dimethylamino)pyridine and 30 g of tetrahydrofuran was added dropwise thereto over one hour. After stirring the mixture for 2 hours, 5 g of a 85 wt % aqueous solution of formic acid was added to the mixture, followed by stirring for 30 minutes. The precipitated crystals were filtered, and the solvent was distilled off from the filtrate under reduced pressure at a temperature of 25° C. to obtain a polymer (a high molecular weight polymerization initiator) represented by the following formula having an Mw of $6.3\times10^3$.

(Polymerization Initiator)

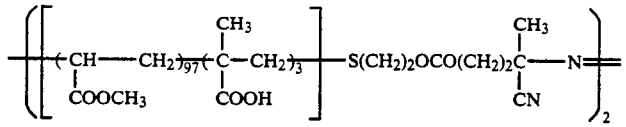

A mixed solution of 70 g of dodecyl methacrylate and 170 g of toluene was heated at a temperature of 70° C. while stirring in a nitrogen stream. Then, a solution of 30 g of the above-described polymer in 30 g of toluene which had been substituted with nitrogen was added thereto, followed by reacting for 8 hours. The resulting polymer was precipitated from 2 liters of methanol, collected and dried to obtain 72 g of a polymer having the following formula and an Mw of $4\times10^4$.

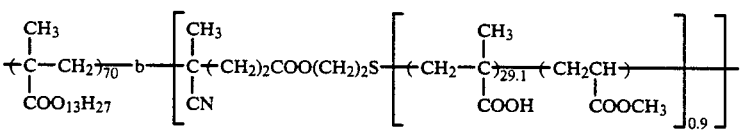

(P'-8)

PRODUCTION EXAMPLES 9 TO 18 OF DISPERSION-STABILIZING RESIN (P'): P'-9 TO P'-18

Each of the dispersion-stabilizing resins was prepared in the same manner as described in Production Example 6 of Dispersion-Stabilizing Resin (P'), except for using each of the monomers shown in Table 6 below in place of 95 g of hexadecyl methacrylate and 5 g of acrylic acid.

TABLE 6

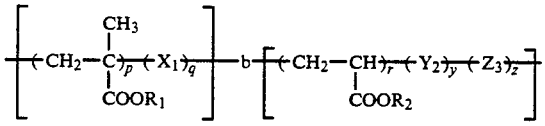

| Production Example | Resin (P') | $R_1$ | $-X_1-$ | $R_2$ | $-Y_2-$ |
|---|---|---|---|---|---|
| 9 | (P'-9) | $-C_{12}H_{25}$ | — | $-CH_3$ | — |
| 10 | (P'-10) | $-C_{16}H_{33}$ | — | $-C_2H_5$ | — |
| 11 | (P'-11) | $-C_{12}H_{25}$ | $-CH_2CH-$ \| $COOC_{12}H_{25}$ | $-CH_3$ | $-CH_2CH-$ \| N, C=O |
| 12 | (P'-12) | $-C_{18}H_{37}$ | $-CH_2CH-$ \| $COOC_{10}H_{21}$ | $-CH_3$ | — |
| 13 | (P'-13) | $-C_{20}H_{41}$ | — | $-CH_3$ | $-CH_2CH-$ \| $COO(CH_2)_2OCH_3$ |
| 14 | (P'-14) | $-C_{18}H_{27}$ | $-CH_2CH-$ \| $COOC_{12}H_{25}$ | $-CH_3$ | $-CH_2CH-$ \| $COCH_3$ |
| 15 | (P'-15) | $-C_{12}H_{25}$ | — | $-C_2H_5$ | — |

TABLE 6-continued

| | $\left[-(CH_2-C(CH_3)(COOR_1))_p-(X_1)_q-\right]_b\left[-(CH_2-CH(COOR_2))_r-(Y_2)_y-(Z_3)_z-\right]$ | | | | |
|---|---|---|---|---|---|
| 16 | (P'-16) | $-C_{13}H_{27}$ | $-CH_2C(CH_3)(COOC_{18}H_{37})-$ | $-CH_3$ | $-CH_2CH(CN)-$ |
| 17 | (P'-17) | $-C_{21}H_{43}$ | — | $-CH_3$ | $-CH_2CH(OCOCH_3)-$ |
| 18 | (P'-18) | $-C_{18}H_{37}$ | — | $-C_2H_5$ | 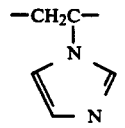 |

| | Production Example | $-Z_3-$ | p/q/r/y/z (weight ratio) |
|---|---|---|---|
| 9 | | $-CH_2-CH(COO(CH_2)_2COOH)-$ | 65/0/32/0/3 |
| 10 | | 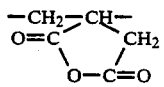 | 72/0/25/0/3 |
| 11 | | $-CH_2C(CH_3)(COOH)-$ | 66/10/20/3/1 |
| 12 | | $-CH_2CH(COO(CH_2)_3SO_3H)-$ | 74/10/15/0/1 |
| 13 | | $-CH_2-C(COOH)(CH_2COOH)-$ | 70/0/20/8/2 |
| 14 | | $-CH_2C(CH_3)(COO(CH_2)_2O-P(=O)(OH)-OH)-$ | 69/10/20/10/1 |
| 15 | | $-CH_2C(CH_3)(COO(CH_2)_2OCO-*)-$ 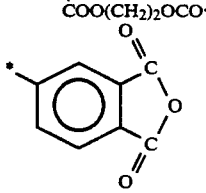 | 81/0/15/0/4 |
| 16 | | $-CH_2CH(CONH(CH_2)_4COOH)-$ | 30/20/45/3/2 |
| 17 | | $-CH_2CH(COO(CH_2)_2OCO(CH_2)_2-COOH)-$ | 70/0/15/10/5 |
| 18 | | — | 80/0/15/5/0 |

PRODUCTION EXAMPLE 1 OF DISPERSION-STABILIZING RESIN (PA'): PA'-1

The polymerization reaction was conducted in the same manner as in Production Example of Resin (P'-1). Then, the resulting mixture was adjusted to a temperature of 0° C., and carbon dioxide gas was passed through the mixture at a flow rate of 10 ml/minute to terminate the polymerization. The temperature of the resulting polymer solution was elevated to 30° C., and 15 ml of a 30% ethanol solution of hydrogen chloride was added thereto, followed by stirring for one hour. The mixture was reprecipitated from 1.5 liter of methanol, and the precipitate was collected and dried. The resulting polymer shown below had an Mw of $4\times10^4$, and the yield of the polymer was 65 g.

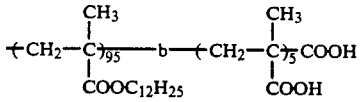

(PA'-1)

PRODUCTION EXAMPLES 2 TO 4 OF DISPERSION-STABILIZING RESIN (PA'): PA'-2 to PA'-4

The polymerization reaction was conducted in the same manner as in each of Production Examples of Resins (P'-2) to (P'-4). Thereafter, the reaction was terminated by passing carbon dioxide gas through the polymerization reaction mixture at a flow rate of 10 ml/minute at a temperature of 0° C. to terminate the polymerization.

Each of the reaction products was worked up in the same manner as in the corresponding Production Example to isolate the following polymers.

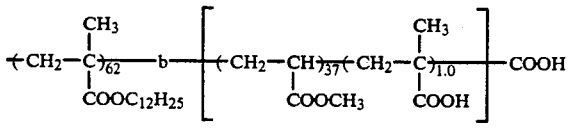

(PA'-2)

Mw: $4.5\times10^4$
Yield: 75 g

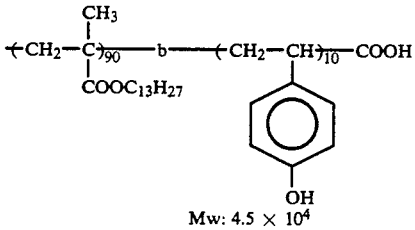

(PA'-3)

Mw: $4.5\times10^4$
Yield: 30 g

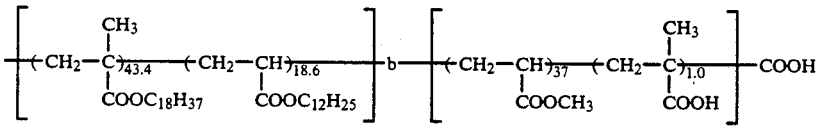

(PA'-4)

Mw: $5.7\times10^4$
Yield: 100 g

PRODUCTION EXAMPLE 5 OF DISPERSION-STABILIZING RESIN (PA'): PA'-5

A mixture of 45 g of methyl acrylate, 5 g of acrylic acid and 2.0 g of 2-carboxyethyl-N,N-dimethyldithiocarbamate (I-1) was placed in a vessel in a nitrogen stream followed by closing the vessel and heated to a temperature of 40° C. The mixture was irradiated with light from a high-pressure mercury lamp of 400 W at a distance of 10 cm through a glass filter for 5 hours to conduct a photopolymerization. After dissolving the reaction mixture in 100 g of tetrahydrofuran, the solution was reprecipitated from 800 ml of methanol to obtain an intermediate having the following structure.

Intermediate for PA'-5

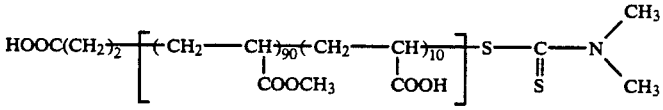

A mixed solution of 15 g of the above intermediate, 85 g of tetradecyl methacrylate and 100 g of tetrahydrofuran was heated to a temperature of 50° C. in a nitrogen stream. The mixture was then irradiated with light in the same manner as described above for 10 hours. Then, the resulting polymer was reprecipitated from one liter of methanol, and the precipitate was collected and dried to obtain 75 g of the following polymer (PA'-5) having an Mw of $6\times10^4$.

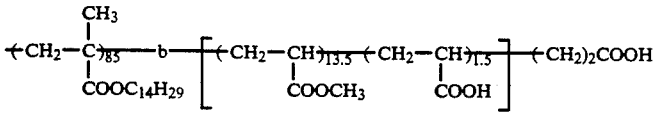

(PA'-5)

PRODUCTION EXAMPLES 6 TO 13 OF DISPERSION-STABILIZING RESIN (PA'): PA'-6 to PA'-13

Each of the polymers was prepared in the same manner as described in Production Example 5 of Resin PA'-5 except for using 0.018 mol of each of the compounds shown in Table 7 below in place of 2-carboxyethyl-N,N-dimethyldithiocarbamate (I-1). The yield of the polymer was in the range of from 70 to 80 g, and the polymer had an Mw in the range of from $5.5\times10^4$ to $7\times10^4$.

PRODUCTION EXAMPLES 14 TO 22 OF DISPERSION-STABILIZING RESIN (PA'): PA'-14 to PA'-22

A mixed solution of the monomer corresponding to the polymer component of B block shown in Table 8 below and 6.2 g of the polymerization initiator (I-10) having the following formula in tetrahydrofuran having a concentration of 50 wt % was heated to a temperature of 50° C. in a nitrogen stream. The mixture was irradiated with light from a high-pressure mercury lamp of 400 W at a distance of 10 cm through a glass filter for 10

TABLE 7

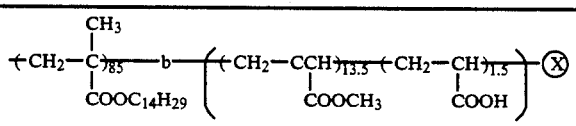

| Production Example of Resin PA' | Resin PA' | Polymerization Initiator | (I) | —Ⓧ |
|---|---|---|---|---|
| 6 | PA'-6 | 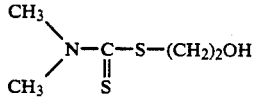 | (I-2) | $-(CH_2)_2OH$ |
| 7 | PA'-7 | 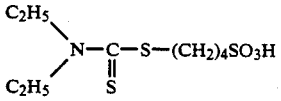 | (I-3) | $-(CH_2)_4SO_3H$ |
| 8 | PA'-8 | 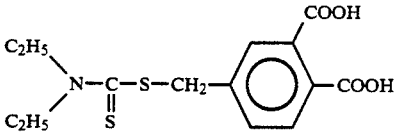 | (I-4) | 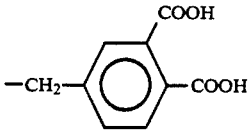 |
| 9 | PA'-9 | 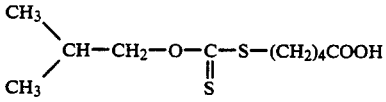 | (I-5) | $-(CH_2)_4COOH$ |
| 10 | PA'-10 | 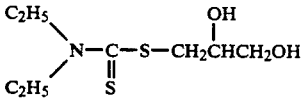 | (I-6) | $-CH_2CHCH_2OH$ (OH) |
| 11 | PA'-11 | 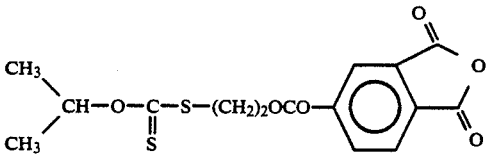 | (I-7) | 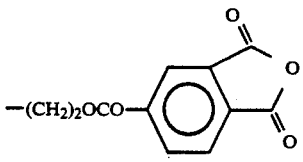 |
| 12 | PA'-12 | 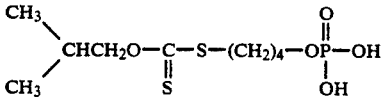 | (I-8) | $-(CH_2)_4O-P(=O)(OH)-OH$ |
| 13 | PA'-13 | 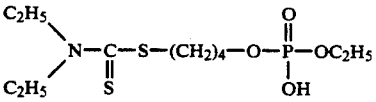 | (I-9) | $-(CH_2)_4O-P(=O)(OH)-OC_2H_5$ |

hours. Then, a solution of the monomer corresponding to the polymer component of A block shown in Table 8 below in tetrahyhrofuran having a concentration of 50 wt % was degassed in a nitrogen stream and added to the above-described reaction solution. The resulting mixture was then reacted for 12 hours under the same light-irradiation condition as described above.

The resulting polymer was reprecipitated in one liter of methanol, and the precipitate was collected and dried to obtain the AB block copolymer shown in Table 8 below in a yield of from 75 to 80% by weight having an Mw of from $3\times10^4$ to $6\times10^4$.

-continued

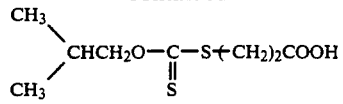

TABLE 8

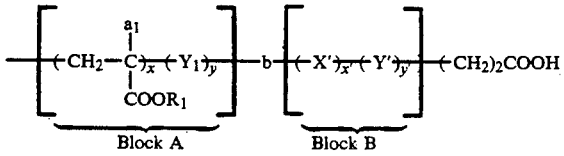

| Production Example of Resin (PA') | Resin (PA') | $a_1$ | $R_1$ | $-Y_1-$ | $-X'-$ | $-Y'-$ | x/y/x'/y' |
|---|---|---|---|---|---|---|---|
| 14 | PA'-14 | $-CH_3$ | $-C_{18}H_{37}$ | — | $-CH_2CH(OCOCH_3)-$ | $-CH(CH_3)-CH(COOH)-$ | 85/0/10/5 |
| 15 | PA'-15 | $-CH_3$ | $-C_{12}H_{25}$ | — | $-CH_2CH(OCOCH_3)-$ | — | 90/0/10/0 |
| 16 | PA'-16 | $-CH_3$ | $-C_{12}H_{25}$ | $-CH_2-C(CH_3)(COOC_{18}H_{37})-$ | $-CH_2-C(CH_3)(COOCH_3)-$ | — | 20/60/20/0 |
| 17 | PA'-17 | $-CH_3$ | $-C_{13}H_{27}$ | $-CH_2-CH(COOC_{18}H_{37})-$ | $-CH_2-C(CH_3)(COO(CH_2)_2OH)-$ | — | 32/60/8/0 |
| 18 | PA'-18 | $-H$ | $-C_{18}H_{37}$ | — | $-CH_2CH(COOCH_3)-$ | — | 85/0/15/0 |
| 19 | PA'-19 | $-H$ | $-C_{20}H_{41}$ | — | $-CH_2-CH(COCH_3)-$ | — | 80/0/20/0 |
| 20 | PA'-20 | $-CH_3$ | $-C_{18}H_{37}$ | — | $-CH_2-C(CH_3)(COOCH_3)-$ | $-CH_2-CH(N)-$ (pyrrolidinone, O) | 85/0/10/5 |
| 21 | PA'-21 | $-CH_3$ | $-C_{16}H_{33}$ | — | $-CH_2-CH(OCOCH_3)-$ | $-CH_2CH(CH_2COOH)-$ | 82/0/10/8 |
| 22 | PA'-22 | $-CH_3$ | $-C_{18}H_{37}$ | — | $-CH_2CH(C_6H_5)-$ | — | 75/0/25/0 |

Polymerization Initiator (I-10)

PRODUCTION EXAMPLE 1 OF DISPERSION-STABILIZING RESIN (PB'): PB'-1

The reaction was conducted in the same manner as in Production Example 1 of Resin PA'-1 until the termination of polymerization reaction by introducing carbon dioxide gas.

To the resulting polymer solution was added 12 g of 2-hydroxyethyl methacrylate, and the temperature of the mixture was adjusted to 25° C. To the mixture was added dropwise a mixed solution of 8 g of dicyclohexylcarbodiimide (abbreviated as DCC), 0.2 g of 4-(N,N-diethylamino)pyridine and 20 g of methylene chloride over one hour. The mixture was allowed to react for 3 hours to terminate the reaction. Then, 20 g of a 30% ethanol solution of hydrogen chloride was added to the reaction mixture, followed by stirring for one hour. The insoluble material was separated by filtration, and the filtrate was reprecipitated from one liter of methanol. The precipitate was collected by filtration and again dissolved in 90 g of toluene. After filtering off the insoluble material, the filtrate was reprecipitated in 500 ml of methanol. The precipitate was collected by filtration and dried to obtain 63 g of the following polymer having an Mw of $4.3\times10^4$.

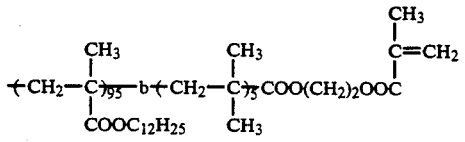

PRODUCTION EXAMPLE 2 TO 4 OF DISPERSION-STABILIZING RESIN (PB'): PB'-2 to PB'-4

In the same manner as described in Production Example 1 of-Resin PB'-1, a polymerizable group was introduced into each of the polymers of Resins PA'-2 to PA'-4 to obtain the following polymers.

ratio and 4.5 g of Polymerization Initiator (I-5) in tetrahydrofuran having a concentration of 50 wt % was heated to a temperature of 50° C. in a nitrogen stream. The mixture was then reacted for 10 hours while irradiating with light in the same manner as described in Production Example 5 of Resin PA'-5.

Then, a solution of the monomer corresponding to A block shown in Table 9 below at the indicated weight ratio in tetrahydrofuran having a concentration of 50 wt % was added to the above mixture, followed by further light-irradiating at a temperature of 50° C. for 10 hours in a nitrogen stream.

The reaction mixture was adjusted to a temperature of 25° C., and to the mixture were added 0.025 mol of each of the polymerizable group-introducing compounds shown in Table 9 below and 30 g of tetrahydrofuran. A mixed solution of 5.2 g of DCC, 0.2 g of 4-(N,N-dimethylamino)pyridine and 10 g of methylene chloride was added dropwise thereto over one hour, followed by reacting for 3 hours.

Then, 10 g of a 80% formic acid solution was added to the reaction mixture and, after stirring for one hour, an insoluble material was separated by filtration, and the resulting filtrate was reprecipitated from 1.5 liter of methanol. The precipitate was collected and dissolved in 200 ml of toluene. The product was reprecipitated again from one liter of methanol, and the precipitate was collected and dried to obtain a polymer having an Mw in the range of from $3.5\times10^4$ to $7\times10^4$ in a yield of from 70 to 80% by weight.

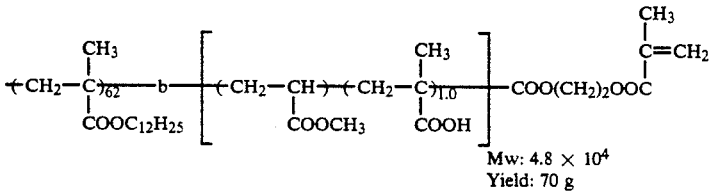

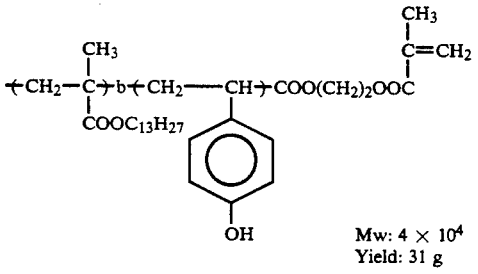

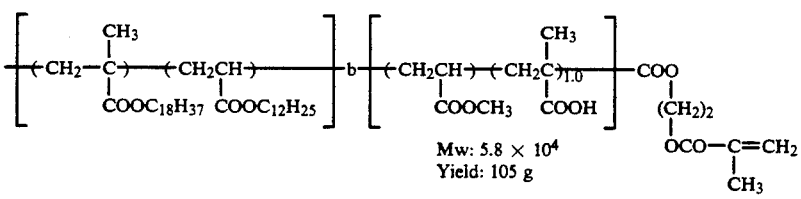

PRODUCTION EXAMPLES 5 TO 12 OF DISPERSION-STABILIZING RESIN (PB'): PB'-5 to PB'-12

A mixed solution of the monomer corresponding to B block shown in Table 9 below at the indicated weight

TABLE 9

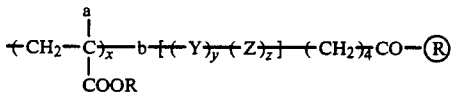

| Production Example of Resin (PB') | Resin (PB') | —a | —R (x) | Polymerizable Group-Introducing Compound |
|---|---|---|---|---|
| 5 | PB'-5 | $-CH_3$ | $-C_{18}H_{37}$ (80) | $HOCH_2CH{=}CH_2$ |
| 6 | PB'-6 | $-CH_3$ | $-C_{18}H_{37}$ (85) | $HOCH{=}CH(CH_3)$ |
| 7 | PB'-7 | $-CH_3$ | $-C_{16}H_{33}$ (85) | $H_2NCH_2CH{=}CH_2$ |
| 8 | PB'-8 | $-CH_3$ | $-C_{18}H_{37}$ (90) | $HO(CH_2)_2OOC(CH{=}CH_2)$ |
| 9 | PB'-9 | $-H$ | $-C_{18}H_{37}$ (90) | $HO(CH_2)_2OOC(CH_3)C{=}CH_2$ |
| 10 | PB'-10 | $-CH_3$ | $-C_{13}H_{27}$ (80) | $HOCH_2$—C$_6$H$_4$—$CH{=}CH_2$ |
| 11 | PB'-11 | $-CH_3$ | $-C_{12}H_{25}$ (90) | $H_2N(CH_2)_2OOC(CH_3)C{=}CH_2$ |
| 12 | PB'-12 | $-CH_3$ | $-C_{18}H_{37}$ (85) | $HOCH_2CH{=}CH_2$ |

| Production Example of Resin (PB') | Introducing (y) | —Y— (z) | —Z— —Ⓡ |
|---|---|---|---|
| 5 | $-CH_2CH(OCOCH_3)-$ (20) | — (0) | $-OCH_2CH{=}CH_2$ |
| 6 | $-CH_2CH(OCOCH_3)-$ (15) | — (0) | $-O-CH{=}CH(CH_3)$ |
| 7 | $-CH_2CH(OCH_3)-$ (15) | — (0) | $-NHCH_2CH{=}CH_2$ |
| 8 | $-CH_2-C(CH_3)(COOCH_3)-$ (10) | — (0) | $-O(CH_2)_2OOC(CH{=}CH_2)$ |
| 9 | $-CH_2-C(CH_3)(COOCH_3)-$ (5) | $-CH_2-CH(COOCH_3)-$ (5) | $-O(CH_2)_2OOC(CH_3)C{=}CH_2$ |

TABLE 9-continued

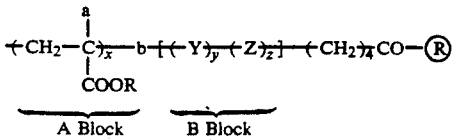

| | A Block | B Block | |
|---|---|---|---|
| 10 | $-CH_2CH-$ (20) | — (0) | $-OCH_2-C_6H_4-CH=CH_2$ |
| 11 | $-CH_2-CH(COOCH_3)-$ (10) | — (0) | $-NH(CH_2)_2OOC-C(CH_3)=CH_2$ |
| 12 | $-CH_2-CH(OCOCH_3)-$ (10) | $-CH_2CH-$ (5) | $-OCH_2CH=CH_2$ |

PRODUCTION EXAMPLES 13 TO 20 OF DISPERSIOIN-STABILIZING RESIN (PB'): PB'-13 to PB'-20

A mixed solution of 43 g of methyl acrylate, 3.9 g of Polymerization Initiator (I-11) having the following structure and 43 g of tetrahydrofuran was subjected to the polymerization reaction by the photopolymerization method for 12 hours in the same manner as in Production Example 5 OF Resin PA'-5. Then, a mixed solution of 70 g of octadecyl methacrylate, 30 g of dodecyl acrylate and 100 g of tetrahydrofuran was added to the reaction mixture, followed by further conducting the photopolymerization in the same manner for 12 hours.

To the resulting polymer solution was added 334 g of tetrahydrofuran, and the temperature of the mixture was adjusted to 20° C. After adding 0.04 mol of each of the polymerizable group-containing carboxylic acid compounds shown in Table 10 below, a mixed solution of 8.3 g of DCC, 0.4 g of 4-(N,N-dimethylamino)pyridine and 15 g of methylene chloride was added dropwise to the mixture over one hour, followed by stirring for 3 hours. 15 g of a 80% formic acid solution was added to the reaction mixture, and the resulting mixture was stirred for one hour. An insoluble material was separated by filtration, and the filtrate was reprecipitated from 1.5 liter of methanol. The precipitate was collected and dried to obtain each of the polymers having an Mw of about $4\times10^4$ in a yield of from 100 to 110 g.

Polymerization Initiator (I-11)

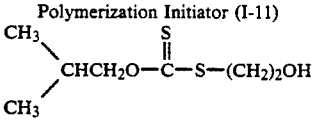

TABLE 10

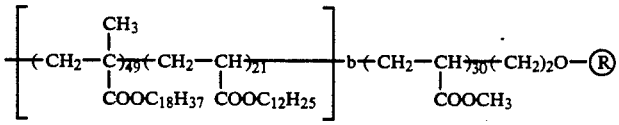

| Production Example of Resin (PB') | Resin (PB') | Polymerizable Group-Containing Carboxylic Acid Compound | —Ⓡ |
|---|---|---|---|
| 13 | PB'-13 | Methacrylic Acid | $-COC(CH_3)=CH_2$ |
| 14 | PB'-14 | Acrylic Acid | $-COCH=CH_2$ |
| 15 | PB'-15 | Crotonic Acid | $-COCH=CH(CH_3)$ |
| 16 | PB'-16 | 4-Vinylbenzenecarboxylic Acid | $-CO-C_6H_4-CH=CH_2$ |
| 17 | PB'-17 | 3-Butenic Carboxylic Acid | $-CO(CH_2)_2CH=CH_2$ |

TABLE 10-continued

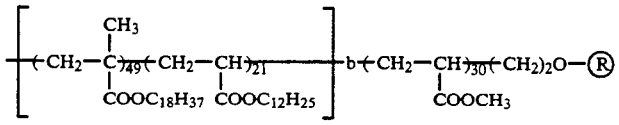

| Production Example of Resin (PB') | Resin (PB') | Polymerizable Group-Containing Carboxylic Acid Compound | —Ⓡ |
|---|---|---|---|
| 18 | PB'-18 | $CH_2=C(CH_3)-COO(CH_2)_2OCO(CH_2)_2COOH$ | $-CO(CH_2)_2COO(CH_2)_2OCO-C(CH_3)=CH_2$ |
| 19 | PB'-19 | $CH_2=CH-COO(CH_2)_2OCO(CH_2)_3COOH$ | $-CO(CH_2)_3COO(CH_2)_3OCO-CH=CH_2$ |
| 20 | PB'-20 | $CH_2=CH-CONH(CH_2)_{10}COOH$ | $-CO(CH_2)_{10}NHCO-CH=CH_2$ |

PRODUCTION EXAMPLE 1 OF LATEX GRAINS: D-1

A mixing solution of 16 g of the dispersion-stabilizing resin P-1, 100 g of vinyl acetate, 2.5 g of octadecyl methacrylate, 5 g of divinyl adipate, and 384 g of Isopar H was heated to 70° C. with stirring under nitrogen gas stream. Then, after adding thereto 0.8 g of 2,2'-azobis-(isovaleronitrile) (abbreviated as A.I.V.N.) as a polymerization initiator, the reaction was carried out for 3 hours. 20 minutes after the addition of the polymerization initiator, the reaction mixture became white-turbid and the reaction temperature raised to 88° C. Then, after adding 0.5 g of the polymerization initiator, followed by reacting for 2 hours, the temperature of the reaction mixture was raised to 100° C. and stirred for 2 hours to distil off unreacted vinyl acetate. After cooling, the reaction mixture was passed through a 200 mesh nylon cloth to obtain the desired latex having a mean grain diameter of 0.22 μm with a polymerization ratio of 90% as a white dispersion. The grain diameter was determined using CAPA-500 (manufactured by Horiba Seisakujo KK), hereinafter the same.

PRODUCTION EXAMPLES 2 TO 21 OF LATEX GRAINS: D-2 to D-21

By following the same procedure as Production Example 1 of latex grains except that each of the dispersion-stabilizing resins, each of the monomers (C) and each of the monomers (D) shown in Table 11 below were used in place of the dispersion-stabilizing resin P-1, octadecyl methacrylate and divinyl adipate, each of the latex grains D-2 to D-21 was produced.

The resulting latex grain had a polymerization ratio of from 85 to 90%, a mean grain diameter of from 0.15 to 0.25 μm and good monodispersibility.

TABLE 11

| Production Example | Latex Grain | Dispersion-Stabilizing Resin | | Monomer (D) | | Monomer (C) | |
|---|---|---|---|---|---|---|---|
| 2 | D-2 | P-2 | 15 g | Divinyl Gluconate | 4 g | Hexadecyl Methacrylate | 3 g |
| 3 | D-3 | P-3 | 15 g | Divinyl Gluconate | 4 g | Dodecyl Methacrylate | 3 g |
| 4 | D-4 | P-4 | 16 g | Divinylbenzene | 3 g | Vinyl Stearate | 5 g |
| 5 | D-5 | P-11 | 14 g | Allyl Methacrylate | 5 g | Dodecyl Methacrylate | 3.3 g |
| 6 | D-6 | PA-1 | 15 g | Divinyl Adipate | 4.5 g | Allyl Laurate | 6 g |
| 7 | D-7 | PA-2 | 14 g | Divinyl Adipate | 4.5 g | Eicosanyl Methacrylate | 2 g |
| 8 | D-8 | PA-4 | 13 g | Vinyl Methacrylate | 3.5 g | Docosanyl Acrylate | 1.8 g |
| 9 | D-9 | PA-5 | 15 g | Allyl Crotonate | 4 g | Tetradecyl Methacrylate | 2 g |
| 10 | D-10 | PA-8 | 14 g | Ethylene Glycol Dimethacrylate | 3 g | $CH_2=C(CH_3)-COOCH_2CH(OCOC_{10}H_{21})CH_2OCOC_{10}H_{21}$ | |
| 11 | D-11 | PA-12 | 15 g | Divinylbenzene | 3.5 g | Hexadecyl Methacrylate | 2.8 g |
| 12 | D-12 | PA-14 | 15 g | Divinylbenzene | 3.5 g | Octadecyl Methacrylate | 2.5 g |
| 13 | D-13 | PA-16 | 16 g | Trivinylbenzene | 3 g | $CH_2=C(CH_3)-COO(CH_2)_2OCO(CH_2)_2COOC_6H_{13}$ | |
| 14 | D-14 | PB-1 | 8 g | Divinylbenzene | 4 g | $CH_2=CH-CONH(CH_2)_6COOC_{12}H_{25}$ | 2 g |
| 15 | D-15 | PB-1 | 8 g | Trivinylbenzene | 4 g | Octadecyl Methacrylate | 2.8 g |
| 16 | D-16 | PB-4 | 7 g | Divinyl Adipate | 5 g | Decyl Methacrylate | 2.0 g |
| 17 | D-17 | PB-6 | 8 g | Vinyl Methacrylate | 4 g | Octadecyl Acrylate | 1.0 g |
| 18 | D-18 | PB-12 | 10 g | Trivinylbenzene | 3.5 g | $CH_2=C(CH_3)-COOCH_2CH(OCOC_6H_{13})CH_2OCOC_6H_{13}$ | 1.4 g |

TABLE 11-continued

| Production Example | Latex Grain | Dispersion-Stabilizing Resin | | Monomer (D) | | Monomer (C) | |
|---|---|---|---|---|---|---|---|
| 19 | D-19 | PB-17 | 7 g | Vinyl Crotonate | 4 g | Octadecyl Crotonate | 1.8 g |
| 20 | D-20 | PB-22 | 6 g | Diallyl Adipate | 6 g | Octadecyl Vinyl Ether | 2 g |
| 21 | D-21 | PB-27 | 4 g | Trimethylolpropane Trimethacrylate | 2 g | $CH_3$ \| $CH{=}CH{-}COO(CH_2)_{10}COOC_8H_{17}$ | 1.5 g |

PRODUCTION EXAMPLE 22 OF LATEX GRAINS: D-22

A mixed solution of 20 g of the dispersion-stabilizing resin PB-18, 70 g of methyl methacrylate, 30 g of ethyl methacrylate, 1.0 g of docosanyl acrylate, 5 g of ethylene glycol diacrylate and 375 g of Isopar H was heated to 40° C. with stirring under nitrogen gas steam. Then, after adding 0.7 g of A.I.V.N. to the reaction mixture, the reaction was carried ou for 4 hours and, after further adding thereto 0.5 g of A.I.V.N., the reaction was carried out for 4 hours. After cooling, the reaction mixture obtained was passed through a 200 mesh nylon cloth to obtain the desired latex grains having a mean grain size of 0.33 μm as a white dispersion with a polymerization ratio of 98%.

PRODUCTION EXAMPLE 23 OF LATEX GRAINS: D-23

A mixed solution of 14 g of the dispersion-stabilizing resin PB-23 and 177 g of Isopar H was heated to 60° C. with stirring under nitrogen gas stream. Then, a mixed solution of 50 g of methyl methacrylate, 50 g of methyl acrylate, 1.4 g of octadecyl acrylate, 3 g of ethylene glycol diacrylate, 200 g of Isopar G and 1.0 g of A.B.V.N. was added dropwise to he reaction mixture over a period of 2 hours, and he resulting mixture was stirred for 2 hours. 0.5 g of A.B.V.N. was further added thereto, and the mixture was stirred for 3 hours. After cooling, the reaction mixture obtained was passed through a 200 mesh nylon cloth to obtain the desired latex grains having a mean grain size of 0.25 μm as a white dispersion with a polymerization ratio of 100%.

PRODUCTION EXAMPLES 24 TO 30 OF LATEX GRAINS: D-24 TO D-30

A latex grain was prepared in the same manner as described in Production Example 23 of Latex Grains except for using each of the compounds shown in Table 12 below in place of the monomers (A) (i.e., methyl methacrylate and methyl acrylate), the monomer (C) (i.e., octadecyl acrylate), the dispersion-stabilizing resin PB-23 and the monomer (D) (i.e., ethylene glycol diacrylate) used in Production Example 23 of Latex Grains.

Each of the later grains had a polymerization ratio of from 95 to 100%, a mean grain diameter in the range of from 0.20 to 0.35 μm and good monodispersibility.

TABLE 12

| Production Example | Latex Grain | Monomer (A) | | Dispersion-Stabilizing Resin | Monomer (D) | | Monomer (C) | |
|---|---|---|---|---|---|---|---|---|
| 24 | D-24 | Styrene | 40 g | PA-11 20 g | Ethylene Glycol Diacrylate | 3 g | Octadecyl Acrylate | 0.8 g |
| | | | | | | | Dodecyl Methacrylate | 1.0 g |
| | | Methyl Methacrylate | 30 g | | | | | |
| | | Ethyl Acrylate | 30 g | | | | | |
| 25 | D-25 | Methyl Methacrylate | 60 g | PB-23 18 g | Ethylene Glycol Dimethacrylate | 4 g | $CH_2{=}CH{-}COOCH_2CH(OCOC_7H_{15})CH_2OCOC_7H_{15}$ | 1.8 g |
| | | n-Propyl Methacrylate | 40 g | | | | | |
| 26 | D-26 | Styrene | 60 g | PB-21 10 g | Divinyl Benzene | 2 g | Octadecyl Vinyl Ketone | 1.5 g |
| | | Vinyl Acetate | 40 g | | | | | |
| 27 | D-27 | Vinyl Acetate | 40 g | P-1 18 g | Divinyl Gluconate | 5 g | $CH_2{=}C(CH_3){-}COO(CH_2)_2OCOC_{11}H_{23}$ | 1.0 g |
| | | Vinyl Benzoate | 60 g | | | | | |
| 28 | D-28 | Methyl Methacrylate | 65 g | P-24 20 g | Trimethylol-propane Triacrylate | 6 g | $CH_2{=}CH{-}COOCH_2CH(OH)CH_2OCOC_{11}H_{23}$ | 1.2 g |
| | | Methyl Acrylate | 30 g | | | | | |
| | | Methacrylic Acid | 5 g | | | | | |
| 29 | D-29 | Vinyl Acetate | 90 g | PA-17 20 g | Trivinylbenzene | 1.5 g | $CH_2{=}CH{-}CONH(CH_2)_{11}COOC_8H_{17}$ | 2.0 g |
| | | Vinyl Pyrrolidone | 10 g | | | | | |
| 30 | D-30 | Vinyl Acetate | 95 g | PB-20 10 g | Trivinylbenzene | 1.5 g | Vinyl Stearate | 5 g |

TABLE 12-continued

| Production Example | Latex Grain | Monomer (A) | Dispersion-Stabilizing Resin | Monomer (D) | Monomer (C) |
|---|---|---|---|---|---|
| | | Crotonic Acid 5 g | | | |

PRODUCTION EXAMPLE 31 OF LATEX GRAINS: COMPARATIVE EXAMPLE A

By following the same procedure as Production Example 1 of latex grains except that 5 g of divinyl adipate as Monomer (D) was omitted, latex grains having a mean grain size of 0.21 μm were obtained with a polymerization ratio of 90% as a white dispersion. (Latex grains disclosed in JP-A-2-16858)

PRODUCTION EXAMPLE 32 OF LATEX GRAINS: COMPARATIVE EXAMPLE B

By following the same procedure as Production Example 14 of latex grains except that 4 g of divinylbenzene as Monomer (D) was omitted, latex grains having a mean grain size of 0.24 μm were obtained with a polymerization ratio of 93% as a white dispersion. (Latex grains disclosed in JP-A-2-186361)

PRODUCTION EXAMPLE 33 OF LATEX GRAINS: COMPARATIVE EXAMPLE C

By following the same procedure as Production Example 22 of latex grains except that 5 g of ethylene glycol diacrylate as Monomer (D) was omitted, latex grains having a mean grain size of 0.28 μm were obtained with a polymerization ratio of 93% as a white dispersion.

PRODUCTION EXAMPLE 34 OF LATEX GRAINS: COMPARATIVE EXAMPLE D

By following the same procedure as Production Example 23 of latex grains except that 3 g of ethylene glycol diacrylate as Monomer (D) was omitted, latex grains having a mean grain size of 0.25 μm were obtained with a polymerization ratio of 100% as a white dispersion.

PRODUCTION EXAMPLE 35 OF LATEX GRAINS: D-35

A mixed solution of 12 g of the dispersion-stabilizing resin PA'-4, 90 g of vinyl acetate, 10 g of methyl vinyl ether, 3 g of octadecyl methacrylate, 3 g of divinyl adipate, and 384 g of Isopar H was heated to 70° C. with stirring under nitrogen gas stream. Then, after adding thereto 0.8 g of A.I.V.N. as a polymerization initiator, the reaction was carried out for 3 hours. 20 minutes after the addition of the polymerization initiator, the reaction mixture became white-turbid and the reaction temperature raised to 88° C. Then, after adding 0.5 g of the polymerization initiator, following by reacting for 2 hours, the temperature of the reaction mixture was raised to 100° C. and stirred for 2 hours to distil off unreacted vinyl acetate. After cooling, the reaction mixture was passed through a 200 mesh nylon cloth to obtain the desired latex having a mean grain size of 0.22 μm with a polymerization ratio of 90% as a white dispersion.

PRODUCTION EXAMPLES 36 TO 55 OF LATEX GRAINS: D-36 TO D-55

By following the same procedure as Production Example 35 of latex grains except that each of the dispersion-stabilizing reins, each of the monomers (C), and each of the monomers (D) shown in Table 13 below were used in place of the dispersion-stabilizing resin PA'-4, octadecyl methacrylate and divinyl adipate, each of the latex grains D-36 to D-55 was produced.

The resulting latex grain had a polymerization ratio of from 85 to 90%, a mean grain diameter of from 0.15 to 0.25 μm and good monodispersibility.

TABLE 13

| Production Example | Latex Grain | Dispersion-Stabilizing Resin | | Monomer (D) | | Monomer (C) | |
|---|---|---|---|---|---|---|---|
| 36 | D-36 | P'-2 | 12 g | Divinyl Gluconate | 4 g | Docosanyl Methacrylate | 2.5 g |
| 37 | D-37 | P'-3 | 14 g | Divinyl Gluconate | 4 g | Dodecyl Methacrylate | 2 g |
| 38 | D-38 | P'-4 | 12 g | Divinylbenzene | 3 g | Octadecyl Methacrylate | 1.5 g |
| 39 | D-39 | P'-5 | 12 g | Allyl Methacrylate | 5 g | Tridecyl Methacrylate | 2 g |
| 40 | D-40 | P'-6 | 13 g | Divinyl Adipate | 4.5 g | Octadecyl Vinyl Ether | 4 g |
| 41 | D-41 | P'-8 | 13 g | Divinyl Adipate | 4.5 g | Octadecyl Vinyl Ketone | 4 g |
| 42 | D-42 | PA'-1 | 10 g | Vinyl Methacrylate | 3.5 g | Octadecyl Methacrylate | 2 g |
| 43 | D-43 | PA'-4 | 14 g | Allyl Crotonate | 4 g | Octadecyl Crotonate | 3.5 g |
| 44 | D-44 | PA'-5 | 12 g | Ethylene Glycol Dimethacrylate | 3 g | $CH_2=C(CH_3)-CH(OCOC_9H_{19})-CH_2OCOC_9H_{19}$ (COOCH2 side) | 3 g |
| 45 | D-45 | PA'-8 | 10 g | Divinylbenzene | 3.5 g | $CH_2=C(CH_3)-COO(CH_2)_2OCOC_{11}H_{23}$ | 2 g |
| 46 | D-46 | PA'-10 | 10 g | Divinylbenzene | 3.5 g | $CH_2=C(CH_3)-COO(CH_2)_2OCOC_{17}H_{35}$ | 1.8 g |

TABLE 13-continued

| Production Example | Latex Grain | Dispersion-Stabilizing Resin | | Monomer (D) | | Monomer (C) | |
|---|---|---|---|---|---|---|---|
| 47 | D-47 | PA'-11 | 10 g | Trivinylbenzene | 3 g | $CH_2{=}C(CH_3){-}CONHCOOC_{14}H_{29}$ | 3.0 g |
| 48 | D-48 | PA'-12 | 10 g | Divinylbenzene | 4 g | Vinyl Stearate | 4 g |
| 49 | D-49 | PB'-5 | 6 g | Trivinylbenzene | 4 g | Allyl Stearate | 4.3 g |
| 50 | D-50 | PB'-6 | 8 g | Divinyl Adipate | 5 g | $CH_2{=}C(CH_3){-}COO(CH_2)_2OCO(CH_2)_2COOC_8H_{17}$ | 3.5 g |
| 51 | D-51 | PB'-12 | 7 g | Vinyl Methacrylate | 4 g | Eicosanyl Methacrylate | 2.0 g |
| 52 | D-52 | PB'-15 | 7 g | Trivinylbenzene | 3.5 g | Octadecyl Methacrylate | 1.5 g |
| 53 | D-53 | PB'-16 | 8 g | Vinyl Crotonate | 4 g | $CH_3{-}CH{=}CH{-}COO(CH_2)_2OCOC_{18}H_{37}$ | 2.5 g |
| 54 | D-54 | PA'-15 | 10 g | Diallyl Adipate | 6 g | 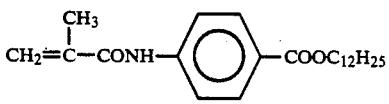 | 3 g |
| 55 | D-55 | PB'-19 | 12 g | Trimethylolpropane Trimethacrylate | 2 g | Octadecyl Stearate<br>Dodecyl Methacrylate | 0.8 g<br>1.2 g |

PRODUCTION EXAMPLE 56 OF LATEX GRAINS: D-56

A mixed solution of 16 g of the dispersion-stabilizing resin PB'-19, 80 g of methyl methacrylate, 20 g of ether acrylate, 3 g of octadecyl acrylate, 3.5 g of ethylene glycol diacrylate and 375 g of Isopar H was heated to 40° C. with stirring under nitrogen gas stream. Then, after adding 0.7 g of A.I.V.N. to the reaction mixture, the reaction was carried out for 4 hours and, after further adding thereto 0.5 g of A.I.V.N., the reaction was carried out for 4 hours. After cooling, the reaction mixture obtained was passed through a 200 mesh nylon cloth to obtain the desired latex grains having a mean grain size of 0.25 μm as a white dispersion with a polymerization ratio of 98%.

PRODUCTION EXAMPLE 57 OF LATEX GRAINS: D-57

A mixed solution of 18 g of the dispersion-stabilizing resin PB'-14 and 177 g of Isopar H was heated to 60° C. with stirring under nitrogen gas stream. Then, a mixed solution of 60 g of methyl methacrylate, 40 g of methyl acrylate, 3.4 g of dodecyl acrylate, 4 g of ethylene glycol diacrylate, 200 g of Isopar G and 0.8 g of A.I.V.N. was added dropwise to the reaction mixture over a period of 2 hours, and the resulting mixture was stirred for 2 hours. 0.5 g of A.I.V.N. was further added thereto, the mixture was stirred for 3 hours. After cooling, the reaction mixture obtained was passed through a 200 mesh nylon cloth to obtain the desired latex grains having a mean grain size of 0.25 μm as a white dispersion with a polymerization ratio of 100%.

PRODUCTION EXAMPLES 58 TO 64 OF LATEX GRAINS: D-58 TO D-64

A latex grain was prepared in the same manner as described in Production Example 57 of Latex Grains except for using each of the compounds shown in Table 14 below in place of the monomers (A) (i.e., methyl methacrylate and methyl acrylate), the dispersion stabilizing resin PB'-14, the monomer (C) (i e , dodecyl acrylate) and the monomer (D) (i.e., ethylene glycol diacrylate) used in Production Example 57 of Latex Grains.

Each of the latex grains had a polymerization ratio of from 95 to 100%, a mean grain diameter in the range of from 0.17 to 0.30 μm and good monodispersibility.

TABLE 14

| Production Example | Latex Grain | Monomer (A) | | Dispersion-Stabilizing Resin | Monomer (D) | | Monomer (C) | |
|---|---|---|---|---|---|---|---|---|
| 58 | D-58 | Styrene | 20 g | PB-1 12 g | Ethylene Glycol Diacrylate | 3 g | Docosanyl Methacrylate | 1 g |
| | | Methyl Methacrylate | 50 g | | | | Dodecyl Acrylate | 1 g |
| | | Methyl Acrylate | 30 g | | | | | |
| 59 | D-59 | Methyl Methacrylate | 60 g | PB-4 11 g | Ethylene Glycol Dimethacrylate | 4 g | $CH_2{=}CH{-}COOCH_2CH(OCOC_{11}H_{23})CH_2OCOC_{11}H_{23}$ | 2.5 g |
| | | n-Propyl Methacrylate | 40 g | | | | | |
| 60 | D-60 | Styrene | 60 g | PB-10 14 g | Divinylbenzene | 2 g | Octadecyl Vinyl Ether | 3 g |

TABLE 14-continued

| Production Example | Latex Grain | Monomer (A) | | Dispersion-Stabilizing Resin | Monomer (D) | | Monomer (C) | |
|---|---|---|---|---|---|---|---|---|
| | | Vinyl Acetate | 40 g | | | | | |
| 61 | D-61 | Styrene | 40 g | PA-22 14 g | Trivinylbenzene | 3 g | Eicosenyl Methacrylate | 3 g |
| | | Vinyl-toluene | 60 g | | | | | |
| 62 | D-62 | Methyl Methacrylate | 65 g | PB-18 8 g | Trimethylol-propane Triacrylate | 4 g | $CH_2=CH$ \| $COO(CH_2)_2OCOC_{14}H_{29}$ | 2.5 g |
| | | Methyl Acrylate | 30 g | | | | | |
| | | Methacrylic Acid | 5 g | | | | | |
| 63 | D-63 | Methyl Methacrylate | 80 g | PA-12 8 g | Trimethylol-propane Methacrylate | 5 g | $CH_2=CH$ \| $CONH(CH_2)_6COOC_{12}H_{25}$ | 3.2 g |
| | | n-Butyl Methacrylate | 20 g | | | | | |
| 64 | D-64 | Vinyl Acetate | 95 g | PB-21 12 g | Trimethylol-propane Methacrylate | 5 g | $CH_3$ \| $CH=CH-COO(CH_2)_2OCO(CH_2)_2COOC_8H_{17}$ | 2.5 g |
| | | Crotonic Acid | 5 g | | | | | |

PRODUCTION EXAMPLE 65 OF LATEX GRAINS: COMPARATIVE EXAMPLE E

By following the same procedure as Production Example 35 of latex grains except that a mixed solution of 20 g of poly(octadecyl methacrylate), 100 g of vinyl acetate and 380 g of Isopar H, latex grain having a mean grain diameter of 0.23 μm were obtained with a polymerization ratio of 88% as a white dispersion.

PRODUCTION EXAMPLE 66 OF LATEX GRAINS: COMPARATIVE EXAMPLE F

By following the same procedure as Production Example 35 of latex grains except that a mixed solution of 12 g of the comparative dispersion-stabilizing resin (1) having the following structure prepared by the method disclosed in JP-A-61-43757, 90 g of vinyl acetate, 10 g of methyl vinyl ether, 3 g of divinylbenzene and 388 g of Isopar H, latex grains having a mean grain diameter of 0.18 μm were obtained with a polymerization ratio of 88% as a white dispersion.

Comparative Dispersion-Stabilizing Resin (1)

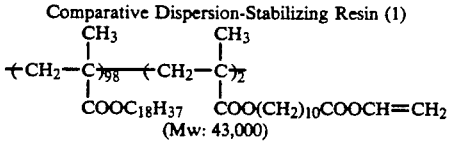

(Mw: 43,000)

PRODUCTION EXAMPLE 67 OF LATEX GRAINS: COMPARATIVE EXAMPLE G

By following the same procedure as Production Example 35 of latex grains except that 3 g of divinyl adipate as Monomer (D) was omitted, latex grains having a mean grain size of 0.22 μm were obtained with a polymerization ratio of 90% as a white dispersion.

PRODUCTION EXAMPLE 68 OF LATEX GRAINS: COMPARATIVE EXAMPLE H

A mixed solution of 97 g of octadecyl methacrylate, 3 g of acrylic acid and 200 g of toluene was heated to a temperature of 75° C. under nitrogen stream, and 1.0 g of A.I.V.N. was added thereto, followed by reacting for 8 hours. Then, 6 g of glycidyl methacrylate, 1.0 g of t-butylhydroquinone and 1.2 g of N,N-dimethyldodecylamine were added thereto, and the mixture was stirred at a temperature of 0° C. for 18 hours. After cooling, the reaction solution was reprecipitated from 2 liters of methanol, and the precipitate was collected and dried to obtain 84 g of a white powder. The resulting comparative dispersion-stabilizing resin (2) had the following structure and an Mw of $5\times10^4$.

Comparative Dispersion-Stabilizing Resin (2)

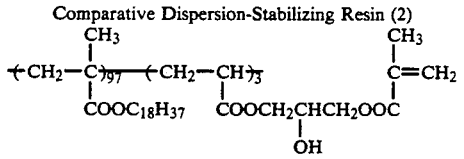

By following the same procedure as Production Example 57 of latex grains except for using 20 g of the above-described comparative dispersion-stabilizing resin in place of 18 g of the dispersion-stabilizing resin PB'-14, latex grains having a mean grain diameter of 0.30 μm were obtained with a polymerization ratio of 98% as a white dispersion.

PRODUCTION EXAMPLE 69 OF LATEX GRAINS: COMPARATIVE EXAMPLE I

By following the same procedure as Production Example 57 of latex grains except that 4 g of ethylene glycol diacrylate as Monomer (D) was omitted, latex grains having a mean grain diameter of 0.23 μm were obtained with a polymerization ratio of 100% as a white dispersion.

EXAMPLE 1

In a paint shaker (manufactured by Tokyo Seiki K.K.) were placed 10 g of a dodecyl methacrylate/a-crylic acid copolymer (95/5 by weight ratio), 10 g of nigrosine, and 30 g of Isopar G together with glass beads and they were dispersed for 4 hours to obtain a fine dispersion of nigrosine.

Then, a liquid developer for electrostatic photography was prepared by diluting 30 g of the latex grains D-1 obtained in Production Example 1 of latex grains, 2.5 g of the above-prepared nigrosine dispersion, 15 g of branched chain octadecyl alcohol, FOC-1800 (trade name, made by Nissan Chemical Industries, Ltd.) and 0.07 g of an octadecene-octadecylamide semi-maleate copolymer diluted with one liter of Isopar G.

Comparative Liquid Developers A and B

Two kinds of comparative liquid developers A and B were prepared in the same manner as above except that each of the resin dispersions (latex grains) shown below was used in place of the latex grains D-1 used above.

Comparative Liquid Developer A

The latex grain obtained in Production Example 31 of latex grains were used.

Comparative Liquid Developer B

The latex grain obtained in Production Example 32 of latex grains were used.

These liquid developers were used for electrophotographic plate-making system to evaluate various characteristics. The results obtained are shown in Table 15 below.

TABLE 15

| | Example 1 | Comparative Example A | Comparative Example B |
|---|---|---|---|
| Stain of Developing Apparatus[1)] | No toner residue adhered | No toner residue adhered | No toner residue adhered |
| Image of the 2,000th Plate[1)] | Clear | Clear | Clear |
| Fixing Property of Image[2)] | Good | Good | Good |
| Resistivity of Toner Image[3)] | Good | Fine lines and letter part lost | Fine lines and letter part lost |
| Printing Durability[4)] | 5,000 sheets | Poor from the start of printing | Poor from the start or printing |

The characteristics items described in Table 15 above were evaluated as follows:

1) Stains of Developing Apparatus and Image of the 2,000th Plate

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 7 plates/minute. Furthermore, after processing 2,000 plates of ELP Master II Type, the occurrence of stains of the developing apparatus by adhesion of the toner was observed. The blackened ratio (imaged area) of the duplicated images was determined using 30% original.

2) Fixing Property of Image

The liquid developer to be tested was used as a developer for the full-automatic processor ELP-404V, and the electrophotographic light-sensitive material P-1 prepared as described below was processed to obtain a printing plate. The resulting plate was then subjected to an abrasion testing machine, and the strength of the image area was visually evaluated. As a reference liquid developer, Liquid Developer ELP-T (trade name, made by Fuji Photo Film Co., Ltd.) which has practically sufficient fixing property was used.

Preparation of Electrophotographic Light-sensitive Material P-1

A mixture of 34 g of Binder Resin (B-1) having the following structure, 6 g of Binder Resin (B-2) having the following structure, 200 g of photoconductive zinc oxide, 0.03 g of uranine, 0.06 g of Rose Bengal, 0.03 g of tetrabromophenol blue, 0.30 g of phthalic anhydride, 0.01 g of o-chlorophenol and 300 g of toluene was dispersed by a homogenizer at a rotation of $1\times10^4$ r.p.m. for 10 minutes to prepare a coating composition for a light-sensitive layer. The coating composition was coated on paper, which had been subjected to electrically conductive treatment, by a wire bar at a dry coverage of 26 g/m$^2$, followed by drying at 100° C. for 30 seconds. The coated material was then heated at 120° C. for one hour and allowed to stand in a dark place at 20° C. and 65% RH for 24 hours to prepare an electrophotographic light-sensitive material P-1.

Binder Resin (B-1)

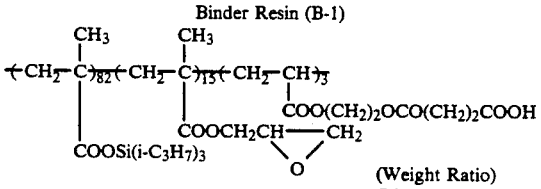

(Weight Ratio)
(Mw: 40,000)

Binder Resin (B-2)

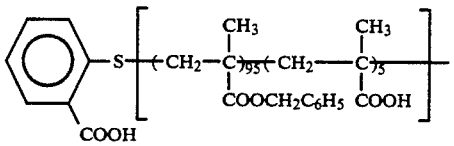

(Mw: 8,000)

3) Resistivity of Toner Image

The plate prepared under the same plate-making conditions as described in 2) above was once passed through an etching machine using Oil-desensitizing Solution ELP-EX (trade mark, made by Fuji Photo Film Co., Ltd.) and then immersed in Oil-desensitizing Solution E-1 having the following formulation for 5 minutes. Thereafter, the plate was washed with water and dried.

The image area of the resulting printing plate was observed by an optical microscope, and the presence of any damages in the image area was visually evaluated.

Preparation of Oil-desensitizing Solution E-1

80 g of diethanoi amine, 8 g of Newcol B4SN (manufactured by Nippon Nyukazai KK and 100 g of benzyl alcohol were dissolved in distilled water to make a total volume of 1 liter, and pH was adjusted to 11.0 with potassium hydroxide to prepare Oil-desensitizing Solution E-1.

4) Printing Durability

The master plate prepared and oil-desensitized in the same manner as described in 3) above was subjected to printing using, as dampening water, a solution prepared by diluting by 20 times Oil-desensitizing Solution E-1 with distilled water and a printing machine, Hamada Star 8005X (manufactured by Hamada Star KK) on neutral papers as a print paper. The resulting print was evaluated by counting a number of prints which could be obtained without the occurrence of any lack of image areas.

As is noted from the results shown in Table 15, the liquid developers of the present invention, and Comparative Examples A and B showed good results without causing stains of the developing apparatus and providing clear images, which indicate good dispersibility and redispersibility of resin grains.

Also, when the mechanical strength of toner images was evaluated by subjecting the toner images to forced abrasion, each of the toner grains was found to be good condition. That is, the grain of the present invention was found to have practically sufficient fixing property.

Further, the plate was tested under forced conditions to determine whether the image areas were sufficiently resisted by the toner layer and whether the image areas were not damaged when zinc oxide and the binder resin B-1 in the non-image areas were chemically treated to render the non-image areas hydrophilic. As a result, it was found that the toner grains other than that of the present invention were lost in fine parts of the toner image areas such as fine lines and fine letters.

Also, when the plate was processed under conventional oil-desensitizing treatment conditions and was then used for printing as an offset master plate, only the plate developed with the liquid developer according to the present invention provided clear prints even after printing 5,000 prints.

On the other hand, with the developers of Comparative Examples A and B, the decreased reproducibility of the duplicated image during the plate-making also appeared in prints, and failures of fine lines and fine letters occurred from the start of printing.

The above results indicated that only the liquid developers according to the present invention provide excellent dispersibility, redispersibility and printing durability in the electrophotographic plate-making system utilizing an electrophotographic light-sensitive material having an improved printing properties.

EXAMPLE 2

A liquid developer for electrostatic photography was prepared by diluting 30 g of the resin dispersion D-22 prepared in Production Example 22 of Latex Grains, 10 g of branched hexadecyl alcohol, FOC-1600 (trade name, made by Nissan Chemical Industries, Ltd.) and 0.06 g of an octadecylvinyl ether/dodecylamide semimaleate copolymer with one liter of Isopar G.

Comparative Liquid Developers C and D

Two kinds of comparative liquid developers C and D were prepared in the same manner as above except that each of the resin dispersions (latex grains) shown below was used in place of the latex grains D-22 used above.

Comparative Liquid Developer C

The latex grains obtained in Production Example 33 of latex grains were used.

Comparative Liquid Developer D

The latex grains obtained in Production Example 34 of latex grains were used.

These liquid developers were used for electrophotographic plate-making system to evaluate various characteristics. The results obtained are shown in Table 16 below.

TABLE 16

| | Example 2 | Comparative Example C | Comparative Example D |
|---|---|---|---|
| Stains of Developing Apparatus | No toner residue adhered | Toner residue adhered | No toner residue adhered |
| Image of the 2,000th Plate | Clear | Fine lines and letter part lost | Clear |
| Resistivity of Toner Image[5)] | Good | Good | Fine lines and letter part lost (dissolved out) |
| Printing Durability[6)] | More than 100,000 sheets | Fine lines and letter part lost from the start of printing | Fine lines and letter part lost from the start of printing |

In Table 16, the stains of developing apparatus and the image of the 2,000th plate were evaluated in the same manner as described in Example 1. Other characteristic items in Table 16 were evaluated as follows:

5) Resistivity of Toner Image

The electrophotographic light-sensitive material P-2 prepared as described below was charged to a surface potential of +450 V in a dark place. The plate was then exposed at a pitch of 25 μm and a scanning speed of 300 m/sec under irradiation of 60 erg/cm$^2$ on the surface of the light-sensitive material using a gallium-aluminum-arsenic semiconductor laser (oscillation wavelength: 780 nm) with an output of 2.8 mW as a light source, and developed with each of the liquid developers while applying bias potential of 30 V to the opposite electrodes to obtain a toher image on the plate. The plate was then heated at 100° C. for one minute to fix toner image.

Preparation of Electrophotographic Light-sensitive Material P-2

1.9 part by weight of X type non-metal phthalocyanine (made by Dainippon Ink Co., Ltd.) as an organic photoconductive compound, 0.15 part by weight of a thiobarbituric acid compound having the following structure as an additive, 17 parts by weight of Binder Resin B-3 having the following structure, and 100 parts by weight of a mixed solution of tetrahydrofuran/cyclohexane (8/2 by weight) were placed in a 500 ml glass vessel together with glass beads. After dispersing the mixture in a paint shaker for 60 minutes, glass beads were filtered off to prepare a dispersion for the photoconductive layer.

Then, the resulting dispersion was coated on a grained aluminum plate having a thickness of 0.25 mm and dried to prepare an electrophotographic printing plate precursor having a photoconductive layer of 6.0 μm dry coating thickness.

Thiobarbituric Acid Compound

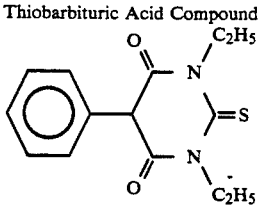

Binder Resin (B-3)

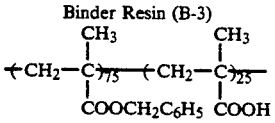

(Mw: 40,000)

Each of the printing plate precursors were immersed in Oil-desensitizing Solution E-2 having the following composition to remove the photoconductive layer in the non-image areas. The plate was washed with water and air-dried by a drier.

| Composition of Oil-desensitizing Solution E-2 | |
|---|---|
| Potassium silicate | 40 g |
| Potassium hydroxide | 10 g |
| Ethanol | 100 g |
| Water | 800 g |

The image areas of the resulting printing plate was visually evaluated through a 60-fold magnifying glass (made by PEAK Co., Ltd.) to determine the presence of loss of fine lines and fine letters.

6) Printing Durability

The master plate for offset printing prepared from each of the light-sensitive material under the same conditions as in 5) above was subjected to a gumming treatment and mounted on an offset printing machine (Oliver 52 Type manufactured by Sakurai Seisakusho KK) to print on high quality paper. A number of prints which could be obtained without occurrence of background stain in the non-image area and deterioration of image quality in the image area of the print was counted. (The higher the number of prints shows the better the printing durability.)

As is noted from the results shown in Table 16, the liquid developers of the present invention and Comparative Developer D showed good redispersibility and good image on the plate after printing 2,000 sheets.

However, in Comparative Example C, toner residue was generated thereby causing stains of the developed areas, and also the image on the plate showed loss of fine lines and fine letters after developing 2,000 plates.

Then, the plate obtained after plate-making was treated with an alkaline processing solution to dissolve out the non-image area to obtain a master plate for offset printing. At this point of time, Comparative Example D causes loss of a small area portion of the toner image such as fine lines and fine letters. This indicates that the resistivity of the toner layer to the processing solution is not sufficient whereby the image area is dissolved out during the processing. On the other hand, with the developers of the present invention and Comparative Example C, the above adverse effect was not observed and showed sufficient resistivity.

Further, when the plate was used for printing as an offset master plate, the plate developed with a developer according to the present invention provided prints having a clear image even after printing 100,000 sheets. However, with Comparative Examples C and D, the image of prints was deteriorated from the start of printing, and prints having a satisfactory image could not be obtained, since Comparative Example C produced poor reproducibility of the duplicated image during the plate-making step, and Comparative Example D did not provide sufficient resistivity to the processing solution for dissolving out the non-image area and, thus, these developers did not provide image reproducibility sufficient for an offset master plate.

The above results indicate that only the liquid developer according to the present invention provide satisfactory dispersibility, redispersibility and printing durability in the electrophotographic plate-making system wherein the printing plate is prepared by dissolving out the non-image area of the electrophotographic light-sensitive material.

EXAMPLE 3

In a paint shaker (manufactured by Tokyo Seiki K. K.) were placed 10 g of a copolymer of dodecyl methacrylate/acrylic acid (95/5 by weight ratio) , 10 g of nigrosine, and 30 g of isopar G together with glass beads followed by dispersing for 4 hours to obtain a fine dispersion of nigrosine.

Then, a liquid developer for electrostatic photography was prepared by diluting 30 g of the resin dispersion obtained in Production Example 11 of latex grains, 2.5 g of the above-prepared nigrosine dispersion, 0.06 g of a copolymer of hexadecene and octadecylamide semi-maleate and 20 of of FOC-1800 (trade name of tetradecyl alcohol, made by Nissan Chemical Industries, Ltd.), with one liter of Isopar G.

The resulting liquid developer of the present invention was evaluated for the stains of the developing apparatus and the image of the 2,000th plate under the same conditions as in 1) of Example 1, and good results similar to those of Example 1 were obtained.

Then, the electrophotographic light-sensitive material P-3 prepared as described below was charged to −6 kV in a dark place. The plate was then exposed at a pitch of 25 μm and a scanning speed of 330 m/sec under irradiation of 45 erg/cm$^2$ on the surface of the light-sensitive material using a gallium-aluminum-arsenic semiconductor laser (oscillation wavelength: 780 nm) with an output of 2.0 mW as a light source, and developed with the liquid developer of the present invention. The plate was then heated at 60° C. for 30 seconds to obtain a toner image.

Preparation of Electrophotographic Light-sensitive Material P-3

A mixture of 25 g of Binder Resin B-4 having the following formula, 9 g of Binder Resin B-5 having the following formula, 6 g of Binder Resin B-6 having the following formula, 200 g of photoconductive zinc oxide, 0.3 g of phthalic anhydride, 0.01 g of phenol, 0.018 g of Cyanine Dye A having the following structure and 300 g of toluene was dispersed in a homogenizer at a rotation of $1\times10^4$ r.p.m. for 10 minutes to prepare a coating composition for a light-sensitive layer. The resulting composition was coated on paper, which had been subjected to electrically conductive treatment, by a wire bar at a dry coverage of 25 g/m$^2$ followed by drying at 100° C. for 20 seconds and then heating at 120°

C. for 1 hour. The coated material was allowed to stand in a dark place at 20° C. and 65% relative humidity (RH) for 24 hours to prepare an electrophotographic light-sensitive material P-3.

Binder Resin (B-4)

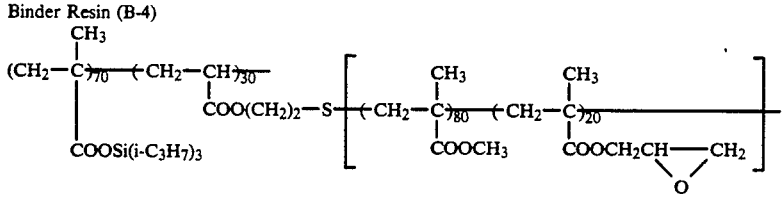

Binder Resin (B-5)

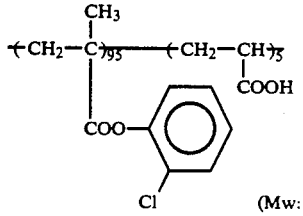

(Mw: 8,000)

Binder Resin (B-6)

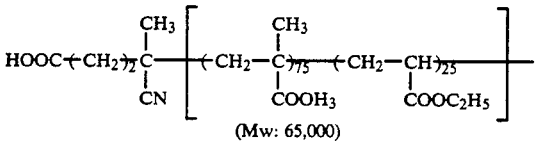

(Mw: 65,000)

Cyanine Dye (a)

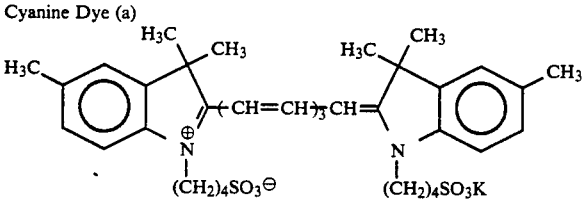

The master plate thus obtained was once passed through an etching machine using ELP-EX, and then immersed in the following oil-desensitizing solution E-3 for the binder resins of the photoconductive layer for 3 minutes, washed with water and dried.

| Preparation of Oil-desensitizing Solution E-3 | |
|---|---|
| Diethanolamine | 80 g |
| Neosoap (manufactured by Matsumoto Yushi KK) | 5 g |
| Methyl ethyl ketone | 80 g |

The above components were dissolved in distilled water to make a total volume of one liter, and pH was adjusted to 11.0 with potassium hydroxide.

The image area of the resulting printing plate was observed through an optical microscope and found to have no loss of fine lines and fine letters in the toner image portion, indicating good resistivity of the toner grain according to the present invention.

Then, the above-described plate was used as an offset master plate and evaluated for the printing durability in the same manner as described in Example 1 expect for using a solution prepared by 50-fold diluting the above Oil-desensitizing Solution E-3 with distilled water as dampening water. As a result, 3,000 sheets of prints having good printed image were obtained.

EXAMPLES 4 TO 15

Each of liquid developers was prepared in the same manner as described in Example 1 except that each of the latex grains shown Table 17 below was used in place of the latex grain D-1 of the liquid developer according to the present invention.

TABLE 17

| Example | Latex Grain (D) | Example | Latex Grain (D) |
|---|---|---|---|
| 4 | D-2 | 10 | D-13 |
| 5 | D-3 | 11 | D-14 |
| 6 | D-4 | 12 | D-18 |
| 7 | D-6 | 13 | D-19 |
| 8 | D-8 | 14 | D-21 |
| 9 | D-9 | 15 | D-27 |

Each of the resulting liquid developers was used in the electrophotographic plate-making system in the same manner as described in Example 1 to determine the performance thereof.

As a result, each of the liquid developers showed similar performance to that of Example 1 and had good redispersibility, fixing property, resistivity and printing durability.

EXAMPLES 16 TO 25

Each of liquid developers was prepared in the same manner as described in Example 2 expect that each of the latex grains shown in Table 18 below was used in place of the latex grain D-22 of the liquid developer according to the present invention.

TABLE 18

| Example | Latex Grain (D) | Example | Latex Grain (D) |
|---|---|---|---|
| 16 | D-24 | 21 | D-25 |

TABLE 18-continued

| Example | Latex Grain (D) | Example | Latex Grain (D) |
|---|---|---|---|
| 17 | D-26 | 22 | D-27 |
| 18 | D-28 | 23 | D-12 |
| 19 | D-21 | 24 | D-13 |
| 20 | D-24 | 25 | D-18 |

Each of the resulting liquid developers was used in the electrophotographic plate-making system in the same manner as described in Example 2 to determine the performance thereof.

As a result, each of the liquid developers showed similar performance to that of Example 2 and had good redispersibility, fixing property, resistivity and printing durability.

EXAMPLE 26

A mixture of 100 g of the white resin dispersion obtained in Production Example 10 of latex grains and 1.5 g of Sumikalon black was heated to 100° C. and stirred for 4 hours at that temperature. After cooling to room temperature, the reaction mixture was passed through a 200 mesh nylon cloth to remove the remaining dye, whereby a black resin dispersion having a mean grain diameter of 0.21 μm was obtained.

Then, a liquid developer was prepared by diluting 30 g of the above-prepared black resin dispersion, and 0.05 g of zirconium naphthenate with one liter of Shellsol 71.

When the liquid developer was applied to the same developing apparatus as in Example 1 for making printing plates, no occurrence of stains of the developing apparatus by sticking of the toner was observed even after developing 2,000 plates.

Also, the quantity of the offset printing master plate obtained was clear and also the image quality of the 3,000 prints formed using the master plate was very clear.

EXAMPLE 27

A mixture of 100 g of the white dispersion obtained in Production Example 30 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain diameter of 0.25 μm was obtained.

Then, a liquid developer was prepared by diluting 32 g of the above-prepared blue resin dispersion, and 0.05 g of zirconium naphthenate with one liter of Isopar H.

When the liquid developer was applied to the same developing apparatus as in Example 3 for making printing plates, no occurrence of stains of the developing apparatus by sticking of the toner was observed even after developing 2,000 plates. Also, the image quality of the images on the offset printing master plate obtained was clear and also the image quality of the 3,000th print was very clear.

EXAMPLE 28

In a paint shaker (manufactured by Tokyo Seiki K.K.) were placed 10 g of a dodecyl methacrylate/acrylic acid copolymer (95/5 by weight ratio), 10 g of nigrosine, and 30 g of Isopar G together with glass beads and they were dispersed for 4 hours to obtain a fine dispersion of nigrosine.

Then, a liquid developer for electrostatic photography was prepared by diluting 30 g of the latex grains D-35 obtained in Production Example 35 of latex grains, 2.5 g of the above-prepared nigrosine dispersion, 15 g of branched chain octadecyl alcohol, FOC-1800 (trade name, made by Nissan Chemical Industries, Ltd.) and 0.07 g of an octadecene-octadecylamide semi-maleate copolymer diluted with one liter of Isopar G.

Comparative Liquid Developers E to G

Three kinds of comparative liquid developers E to G were prepared in the same manner as above except that each of the resin dispersions (latex grains) shown below was used in place of the latex grains D-35 used above.

Comparative Liquid Developer E

The latex grains obtained in Production Example 65 of latex grains were used.

Comparative Liquid Developer F

The latex grains obtained in Production Example 66 of latex grains were used.

Comparative Liquid Developer G

The latex grains obtained in Production Example 67 of latex grains were used.

These liquid developers were used for electrophotographic plate-making system to evaluate various characteristics. The results obtained are shown in Table 19 below.

The characteristic items described in Table 19 were evaluated in the same manner as described in Example 1.

TABLE 19

| | Example 28 | Comparative Example E | Comparative Example E | Comparative Example G |
|---|---|---|---|---|
| Stain of Developing Apparatus | No toner residue adhered | Toner residue markedly adhered | Toner residue adhered | No toner residue adhered |
| Image of the 2,000th Plate | Clear | Letter part lost, solid black portion blurred, background portion fogged | Letter part lost, density of solid black lowered | Clear |
| Fixing Property of Image | Good | Good | Good | Good |
| Resistivity of Toner Image | Good | Fine lines and letter part lost | Fine lines and letter part lost | Fine lines and letter part lost |
| Printing Durability | 5,000 sheets | Poor from the start of printing | Poor from the start or printing | 2,000 sheets |

As is noted from the results shown in Table 19, the liquid developers of the present invention, and Comparative Example G showed good results without causing stains of the developing apparatus and providing clear images, which indicate good dispersibility and redispersibility of resin grains.

On the other hand, the developers of Comparative Examples E and F showed deteriorated redispersibility which adversely affects the reproduction of the duplicated image.

Also, when the mechanical strength of toner images was evaluated by subjecting the toner images to forced abrasion, each of the toner grains was found to be good condition. That is, the grain of the present invention was found to have practically sufficient fixing property.

Further, the plate was tested under forced conditions to determine whether the image areas were sufficiently resisted by the toner layer and whether the image area were not damaged when zinc oxide and the binder resin B-1 in the non-image areas were chemically treated to render the non-image areas hydrophilic. As a result, it was found that the toner grains other than that of the present invention were lost in fine parts of the toner image areas such as fine lines and fine letters.

Also, when the plate was processed under conventional oil-desensitizing treatment conditions and was then used for printing as an offset master plate, only the plate developed with the liquid developer according to the present invention provided clear prints even after printing 5,000 prints.

On the other hand, with the developers of Comparative Examples E and F, the decreased reproducibility of the duplicated image during the plate-making also appeared in prints, and failures of fine lines and fine letters occurred from the start of printing. Also, with the developer of Comparative Example G, loss of fine lines and fine letters occurred in the prints over about 2,000 sheets from the start of printing.

The above results indicate that only the liquid developers according to the present invention provide excellent dispersibility, redispersibility and printing durability in the electrophotographic plate-making system utilizing an electrophotographic light-sensitive material having an improved printing properties.

EXAMPLE 29

A liquid developer for electrostatic photography was prepared by diluting 30 g of the resin dispersion D- 57 prepared in Production Example 57 of Latex Grains, 10 g of branched hexadecyl alcohol, FOC-1600 (trade name, made by Nissan Chemical Industries, Ltd.) and 0.06 g of an octadecylvinyl ether/dodecylamide semimaleate copolymer with one liter of Isopar G.

Comparative Liquid Developers H and I

Two kinds of comparative liquid developers H and I were prepared in the same manner as above except that each of the resin dispersions (latex grains) shown below was used in place of the latex grains D-57 used above.

Comparative Liquid Developer H

The latex grains obtained in Production Example 68 of latex grains were used.

Comparative Liquid Developer I

The latex grains obtained in Production Example 69 of latex grains were used.

These liquid developers were used for electrophotographic plate-making system to evaluate various characteristics. The results obtained are shown in Table 20 below.

In Table 20, the characteristic items of stains of developing apparatus and image of the 2,000th plate were evaluated in the same manner as described in Example 28, and other characteristic items were evaluated in the same manner as described in Example 2.

TABLE 20

| | Example 29 | Comparative Example H | Comparative Example I |
|---|---|---|---|
| Stain of Developing Apparatus | No toner residue adhered | Toner residue adhered | No toner residue adhered |
| Image of the 2,000th Plate | Clear | Fine lines and letter part lost | Clear |
| Resistivity of Toner Image | Good | Good | Fine lines and letter part lost (dissolved out) |
| Printing Durability | More than 100,000 sheets | Fine lines and letter part lost from the start of printing | Fine lines and letter part lost from the start of printing |

As is noted from the results shown in Table 20, the liquid developers of the present invention and Comparative Developer I showed good redispersibility and good image on the plate after printing 2,000 sheets.

However, in Comparative Example H, toner residue was generated thereby causing stains of the developed areas, and also the image on the plate showed loss of fine lines and fine letters after developing 2,000 plates.

Then, the plate obtained after plate-making was treated with an alkaline processing solution to dissolve out the non-image area to obtain a master plate for offset printing. At this point of time, Comparative Example I showed loss of a small area portion of the toner image such as fine lines and fine letters. This indicates that the resistivity of the toner layer to the processing solution is not sufficient whereby the image area is dissolved out during the processing. On the other hand, with the developers of the present invention and Comparative Example H, the above adverse effect was not observed and showed sufficient resistivity.

Further, when the plate was used for printing as an offset master plate, the plate developed with a developer according to the present invention provided prints having a clear image even after printing 100,000 sheets. However, with Comparative Examples H and I, the image of prints was deteriorated from the start of printing, and prints having a satisfactory image could not be obtained, since Comparative Example H produced poor reproducibility of the duplicated image during the plate-making step, and Comparative Example I did not provide sufficient resistivity to the processing solution for dissolving out the non-image area and, thus, these developers did not provide image reproducibility sufficient for an offset master plate.

The above results indicate that only the liquid developers according to the present invention provide satisfactory dispersibility, redispersibility and printing durability in the electrophotographic plate-making system wherein the printing plate is prepared by dissolving out the non-image area of the electrophotographic light-sensitive material.

EXAMPLE 30

In a paint shaker (manufactured by Tokyo Seiki K.K.) were placed 10 g of a copolymer of dodecyl methacrylate/acrylic acid (95/5 by weight ratio), 10 g of nigrosine, and 30 g of Isopar G together with glass beads followed by dispersing for 4 hours to obtain a fine dispersion of nigrosine.

Then, a liquid developer for electrostatic photography was prepared by diluting 30 g of the resin dispersion obtained in Production Example 36 of latex grains, 2.5 g of the above-prepared nigrosine dispersion, 0.06 g of a copolymer of hexadecene and octadecylamide semi-maleate and 20 g of FOC-1800 (trade name of tetradecyl alcohol, made by Nissan Chemical Industries, Ltd.), with one liter of Isopar G.

The resulting liquid developer of the present invention was evaluated for the stains of the developing apparatus and the image of the 2,000 plate under the same conditions as in 1) of Example 1, and good results similar to those of Example 28 were obtained.

Then, the electrophotographic light-sensitive material P-3 used in Example 3 above was charged to −6 kV in a dark place. The plate was then exposed at a pitch of 25 μm and a scanning speed of 330 m/sec under irradiation of 45 erg/cm$^2$ on the surface of the light-sensitive material using a gallium-aluminum-arsenic semiconductor laser (oscillation wavelength: 780 nm) with an output of 2.0 mW as a light source, and developed with the liquid developer of the present invention. The plate was then heated at 60° C. for 30 seconds to obtain a toner image.

The master plate thus obtained was once passed through an etching machine using ELP-EX, and then immersed in the oil-desensitizing solution E-3 for the binder resins of the photoconductive layer prepared in Example 3, washed with water and dried.

The image area of the resulting printing plate was observed through an optical microscope and found to have no loss of fine lines and fine letters in the toner image portion, indicating good resistivity of the toner grain according to the present invention.

Then, the above-described plate was used as an offset master plate and evaluated for the printing durability in the same manner as described in Example 28 expect for using a solution prepared by 50-fold diluting the Oil-desensitizing Solution E-3 prepared in Example 3 with distilled water as dampening water. As a result, 3,000 sheets of prints having good printed image were obtained.

EXAMPLES 31 TO 42

Each of liquid developers was prepared in the same manner as described in Example 28 except that each of the latex grains shown Table 21 below was used in place of the latex grain D-35 of the liquid developer according to the present invention.

TABLE 21

| Example | Latex Grain (D) | Example | Latex Grain (D) |
|---|---|---|---|
| 31 | D-36 | 37 | D-47 |
| 32 | D-37 | 38 | D-48 |
| 33 | D-38 | 39 | D-52 |
| 34 | D-40 | 40 | D-53 |
| 35 | D-42 | 41 | D-55 |
| 36 | D-43 | 42 | D-61 |

Each of the resulting liquid developers was used in the electrophotographic plate-making system in the same manner as described in Example 28 to determine the performance thereof.

As a result, each of the liquid developers showed similar performance to that of Example 28 and had good redispersibility, fixing property, resistivity and printing durability.

EXAMPLES 43 TO 52

Each of liquid developers was prepared in the same manner as described in Example 29 expect that each of the latex grains shown in Table 22 below was used in place of the latex grain D-57 of the liquid developer according to the present invention.

TABLE 22

| Example | Latex Grain (D) | Example | Latex Grain (D) |
|---|---|---|---|
| 43 | D-59 | 48 | D-58 |
| 44 | D-60 | 49 | D-61 |
| 45 | D-62 | 50 | D-63 |
| 46 | D-56 | 51 | D-45 |
| 47 | D-55 | 52 | D-54 |

Each of the resulting liquid developers was used in the electrophotographic plate-making system in the same manner as described in Example 29 to determine the performance thereof.

As a result, each of the liquid developers showed similar performance to that of Example 29 and had good redispersibility, fixing property, resistivity and printing durability.

EXAMPLE 53

A mixture of 100 g of the white resin dispersion obtained in Production Example 57 of latex grains and 1.5 g of Sumikalon black was heated to 100° C. and stirred for 4 hours at that temperature. After cooling to room temperature, the reaction mixture was passed through a 200 mesh nylon cloth to remove the remaining dye, whereby a black resin dispersion having a mean grain diameter of 0.21 μm was obtained.

Then, a liquid developer was prepared by diluting 30 g of the above-prepared black resin dispersion, and 0.05 g of zirconium naphthenate with one liter of Shellsol 71.

When the liquid developer was applied to the same developing apparatus as in Example 28 for making printing plates, no occurrence of stains of the developing apparatus by sticking of the toner was observed even after developing 2,000 plates.

Also, the quantity of the offset printing master plate obtained was clear and also the image quality of the 3,000th print printed using the master plate was very clear.

EXAMPLE 54

A mixture of 100 g of the white dispersion obtained in Production Example 55 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, whereby a blue resin dispersion having a mean grain diameter of 0.25 μm was obtained.

Then, a liquid developer was prepared by diluting 32 g of the above-prepared blue resin dispersion, and 0.05 g of zirconium naphthenate with one liter of Isopar H.

When the liquid developer was applied to the same developing apparatus as in Example 30 for making printing plates, no occurrence of stains of the developing apparatus by sticking of the toner was observed even after developing 2,000 plates. Also, the image quantity of the images on the offset printing master plate obtained was clear and also the image quality of the 3,000th print was very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising at least resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing (1) at least one monofunctional monomer (A) which is soluble in said non-aqueous solvent but becomes insoluble therein by being polymerized, (2) at least one monomer (C) represented by the general formula (I) below which contains a specific substituent and which is copolymerizable with said monofunctional monomer (A), (3) at least one polyfunctional monomer (D) having at least two polymerizable functional groups which are copolymerizable with said monofunctional monomer (A), and (4) at least one dispersion-stabilizing resin (P) soluble in said non-aqueous solvent, which is a polymer containing a repeating unit represented by the general formula (II) and the main chain of said polymer is partially crosslinked, or at least one dispersion-stabilizing resin (P') soluble in said non-aqueous solvent, which is an AB block copolymer having a weight average molecular weight from $1\times10^4$ to $5\times10^5$ composed of an A block containing at least a polymerizable component represented by the general formula (II') described below and a B block comprising a polymerizable component containing at least one polar group selected from a carboxy group, a sulfo group, a hydroxyl group, a formyl group, an amino group, a phosphono group, a

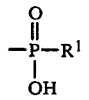

group (wherein $R^1$ represents $—R^2$ or $—OR^2$ (wherein $R^2$ represents a hydrocarbon group)), a

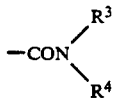

group, a

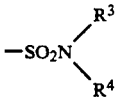

group (wherein $R^3$and $R^4$ each represents a hydrogen atom or a hydrocarbon group) and a cyclic acid anhydride-containing group, and/or a polymerizable component corresponding to the monofunctional monomer (A);

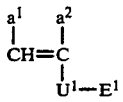

(I)

wherein $E^1$ represents an aliphatic group having 8 or more carbon atoms or a substituent selected from the substituents represented by the general formula (III)

$$—(A^1—B^1)_m—(A^2—B^2)_n—R^{21} \quad \text{(III)}$$

wherein $R^{21}$ represents a hydrogen atom or an aliphatic group having from 1 to 18 carbon atoms, $B^1$ and $B^2$, which may be the same different, each represents —O—, —S—, —CO—, $—CO_2—$ —OCO—, $—SO_2—$,

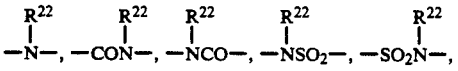

$—NHCO_2—$ or —NHCONH— (wherein $R^{22}$ has the same meaning as $R^{21}$), $A^1$ and $A^2$, which may be the same or different, each has a hydrocarbon group having from 1 to 18 carbon atoms which may be substituted and which may contain an intervening group represented by the following formula in the main chain of said hydrocarbon group;

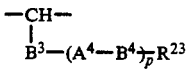

(wherein $B^3$ and $B^4$, which maybe the same or different, each has the same meaning as $B^1$ and $B^2$, $A^4$ represents a hydrocarbon group having from 1 to 18 carbon atoms which may be substituted, and $R^{23}$ has the same meaning as $R^{21}$), m, n and p, which may be the same or different, each represents an integer of from 0 to 4, provided that m, n and p cannot be 0 at the same time; $U^1$ represents —COO—, —CONH—,

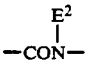

(wherein $E^2$ represents an aliphatic group or a substituent represented by the above general formula (III)), —OCO—, —CONHCOO—, $—CH_2COO—$, $—(CH_2)_sOCO—$ (wherein s represents an integer of from 1 to 4), —O— or $—C_6H_4—COO—$; $a^1$ and $a^2$, which may be the same or different, each represents a hydrogen atom, an alkyl group, $—COO—E^3$ or $—CH_2COO—E^3$ (wherein $E^3$ represents an aliphatic group);

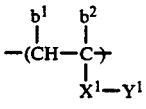

(II)

wherein $X^1$ represents —COO—, —OCO—, $—CH_2OCO—$, $—CH_2COO—$, —O— or $—SO_2—$; $Y_1$ represents an aliphatic group containing from 6 to 32 carbon atoms; $b^1$ and $b^2$ which may be the same or different, each represents a hydrogen atom, a halogen atom, a cyano group, a hydrocarbon group having from 1 to 8 carbon atoms, $—COO—Z^1$ or $—COO—Z^1$ bonded via a hydrocarbon group having from 1 to 8 carbon atoms (wherein $Z^1$ represents a hydrocarbon group having from 1 to 22 carbon atoms);

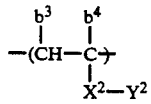

(II')

wherein $X^2$ represents —COO—, —OCO—, $-(CH_2)_y-COO-$, $-(CH_2)_y-OCO-$ (wherein y represents an integer of from 1 to 3) or —O—; $Y^2$ represents an aliphatic group having 10 or more carbon atoms; $b^3$ and $b^4$, which may be the same or different, each represents a hydrogen atom, a halogen atom, a cyano group, a hydrocarbon group, a $-COO-Z^2$ group or a $-COO-Z^2$ group bonded via a hydrocarbon group (wherein $Z^2$ represents a hydrogen atom or a hydrocarbon group which may be substituted).

2. A liquid developer for electrophotography as claimed in claim 1, wherein said polymer as dispersion-stabilizing resin (P) conta-ins at least one polar group selected from $-PO_3H_2$, $-SO_3H$, —COOH,

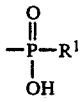

(wherein $R^1$ represents a hydrocarbon group or $-OR^2$ (wherein $R^2$ represents a hydrocarbon group), —OH, a formyl group,

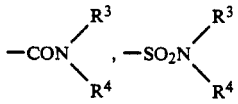

(wherein $R^3$ and $R^4$ each represents a hydrogen atom or a hydrocarbon group), a cyclic acid anhydride-containing group, and an amino group, at one terminal of the main chain of said polymer.

3. A liquid developer for electrophotography as claimed in claim 1, wherein said polymer as dispersion-stabilizing resin (P) contains a polymerizable functional group which is copolymerizable with said monomer (A), at one terminal of the main chain of said polymer.

4. A liquid developer for electrophotography as claimed in claim 1, wherein said AB block copolymer as dispersion-stabilizing resin (P') contains at least one polar group selected from the specific groups contains in said B block, at the terminal of the polymer main chain of the B block opposite to the terminal adjacent to the A block.

5. A liquid developer for electrophotography as claimed in claim 1, wherein said AB block copolymer as dispersion-stabilizing resin (P') contains polymerizable functional group which is copolymerizable with said monomer (A), at the terminal of the polymer main chain of the B block opposite to the terminal adjacent to the A block.

6. A liquid developer for electrostatic photography as in claim 1, wherein said monofunctional monomer (A) is represented by the formula (IV):

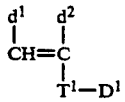

(IV)

wherein $T^1$ represents —COO—, —OCO—, $-CH_2OCO-$, $-CH_2COO-$, —O—, —CONHCOO—, —CONHOCO—, $-SO_2-$,

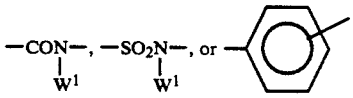

(wherein $W^1$ represents a hydrogen atom or an aliphatic group having from 1 to 8 carbon atoms which may be substituted), $D^1$ represents a hydrogen atom or an aliphatic group having form 1 to 6 carbon atoms, and $d^1$ and $d^2$ which may be the same or different, each represents a hydrogen atom, a halogen atom, a cyano group, a hydrocarbon group having from 1 to 8 carbon atoms, $-COO-Z^1$ or $-COO-Z^1$ bonded via a hydrocarbon group (wherein $Z^1$ represents a hydrocarbon group having from 1 to 22 carbon atoms).

7. A liquid developer for electrostatic photography as in claim 1, wherein a proportion of the A block and the B block in said AB block copolymer is from 99/1 to 50/50 by weight.

8. A liquid developer for electrostatic photography as in claim 1, wherein said AB block copolymer has a weight average molecular weight of from $2\times10^4$ to $1\times10^5$.

9. A liquid developer for electrostatic photography as in claim 1, wherein said dispersion-stabilizing resin is used in an amount of from 1 to 100 parts by weight per 100 parts by weight of the monofunctional monomer (A).

10. A liquid developer for electrostatic photography as claimed in claim 1, wherein the liquid developer further contains a coloring agent.

* * * * *